US006057635A

United States Patent [19]

Nishimura et al.

[11] Patent Number: 6,057,635

[45] Date of Patent: May 2, 2000

[54] LOW-PRESSURE MERCURY VAPOR-FILLED DISCHARGE LAMP, LUMINAIRE AND DISPLAY DEVICE

[75] Inventors: Kiyoshi Nishimura; Ariyoshi Ishizaki, both of Yokosuka; Kunio Yuasa, Chigasaki; Masuo Shibuya, Yokosuka; Masami Takagi, Yokohama; Naoki Tsutsui, Yokosuka; Miho Saito; Shinji Mochimaru, both of Yokohama, all of Japan

[73] Assignee: Toshiba Lighting and Technology Corporation, Japan

[21] Appl. No.: 08/960,534

[22] Filed: Oct. 31, 1997

[30] Foreign Application Priority Data

| | | | |
|---|---|---|---|
| Oct. 31, 1996 | [JP] | Japan | 8-290923 |
| Nov. 5, 1996 | [JP] | Japan | 8-292575 |
| Nov. 5, 1996 | [JP] | Japan | 8-292942 |
| Nov. 29, 1996 | [JP] | Japan | 8-320602 |
| Dec. 10, 1996 | [JP] | Japan | 8-329653 |
| Jan. 31, 1997 | [JP] | Japan | 9-019538 |
| Mar. 31, 1997 | [JP] | Japan | 9-080489 |
| Apr. 15, 1997 | [JP] | Japan | 9-097386 |
| Apr. 30, 1997 | [JP] | Japan | 9-112813 |
| Jul. 16, 1997 | [JP] | Japan | 9-191425 |
| Aug. 29, 1997 | [JP] | Japan | 9-235147 |

[51] Int. Cl.[7] ..... H01J 61/12; H01J 61/34

[52] U.S. Cl. ..... 313/25; 313/27; 313/47; 313/572; 313/577; 313/493; 313/634

[58] Field of Search ..... 313/25, 17, 26, 313/27, 47, 571, 639, 572, 577, 493, 634

[56] References Cited

U.S. PATENT DOCUMENTS

| | | | |
|---|---|---|---|
| 3,110,833 | 11/1963 | Larson | 313/26 |
| 4,949,003 | 8/1990 | Cox et al. | 313/26 X |

*Primary Examiner*—Ashok Patel
*Attorney, Agent, or Firm*—Morrison Law Firm

[57] ABSTRACT

A low-pressure mercury vapor-filled discharge lamp has a glass arc tube and a glass outer tube disposed coaxially with the arc tube forming a space therebetween. A gas is disposed in the space. The arc tube contains a gas and is coated with a phosphor. A first seal hermetically seals the inner tube. A second seal seals the inner tube to the outer tube. The inner tube further contains a pair of cathodes coupled to Dumet wires extending from the interior of the inner tube to the outside of the lamp structure. The pressure in the space is set at not more than 1 Pa, which is nearly high vacuum. The longer the radial dimension of the space, the greater the heat retaining capacity and the better the temperature characteristics which can be obtained. However, by setting the pressure of the space at 1 Pa or less, the optimum heat retaining capacity can be obtained while reducing the diameter of the low-pressure mercury vapor filled discharge lamp 1.

23 Claims, 14 Drawing Sheets

LOW-PRESSURE MERCURY VAPOR-FILLED DISCHARGE LAMP, LUMINAIRE AND DISPLAY DEVICE

BACKGROUND OF THE INVENTION

The present invention relates to a low-pressure mercury vapor-filled discharge lamp, a luminaire and a display device having a reduced diameter and an improved efficiency.

An example of well-known conventional low-pressure mercury vapor-filled discharge lamps using a double tube is disclosed in Japanese Utility Model Publication No. 52932/1992. That publication discloses a low-pressure mercury vapor-filled discharge lamp including an elongated cylindrical glass inner tube and a glass outer tube coaxially encompassing the inner tube with a space therebetween, the inner tube and the outer tube supported by support members at the ends thereof. The space thermally insulates the inner tube from the outside air so that the decrease in the luminance efficiency can be held down to a minimum even under the conditions where both the electric power input to the lamp and the heat capacity of the lamp are small and the temperature in the environment is low.

According to the above configuration, however, it is difficult to hermetically connect the inner tube and the outer tube at a low cost, because a support member for such a purpose has to leave sufficient thermal insulation capability and wettability with respect to glass.

In a low-pressure mercury vapor-filled discharge lamp incorporated in a display device, such as a subsurface illuminator facing a side of a light conducting element, a further reduction in the diameter and a further increase in the luminance of the lamp is desired in order to increase its incidence efficiency with respect to the light conducting element. The conventional configuration described above specifies the outer diameter of its inner tube to be 6 mm or less. However, since its electrodes are hot cathodes, there are limitations in reducing the diameter of the tube. In practice, it is difficult to make the inner diameter of the inner tube less than 3 mm. Another problem occurs in cases where a lamp having a space between the inner and the outer tubes in the range of 1 and 10 mm is mounted on a light conducting plate. In those cases, the space between the inner tube and the light conducting plate is too wide, resulting in unfavorably increased light loss. The luminance of a low-pressure mercury vapor-filled discharge lamp may be increased by increasing power input to the lamp. However, the problem cannot be overcome simply by increasing the power input to the lamp, because doing so causes a decrease in the efficiency of the lamp.

Although a discharge lamp is normally lit at a high frequency of more than 10 kHz in order to increase the lamp efficiency, it is a known fact that the efficiency of a discharge lamp adapted to be lit at such a high frequency decreases to a certain extent when mounted on an apparatus. This decrease in efficiency, which is caused by current leakage, is most prominent when the outer diameter of the lamp is less than 8 mm.

OBJECTS AND SUMMARY OF THE INVENTION

It is an object of the present invention to overcome the drawbacks of the prior art.

It is another object of the present invention to provide a discharge lamp with a inner tube having a diameter of less than 3 mm.

It is a further object of the present invention to provide a discharge lamp which retains its efficiency even with changes in ambient temperature and pressure.

It is a still further object to provide a discharge lamp which has a rapid increase of tube surface luminance when actuated.

It is another object to provide a discharge lamp that does not require a high input power for a given luminance output.

It is a further object of the present invention to provide a discharge lamp with reduced light loss when mounted on another apparatus such as a luminaire.

It is yet another object to provide a discharge lamp which is still efficient even when the input power is relatively low or high.

It is still another object to improve the strength of a discharge lamp.

It is a further object to provide a discharge lamp with glass tubes that have the same thermal expansion coefficient.

It is a still further object to provide a discharge lamp with two tubes, both having sealing portions, and the sealing portion of an inner tube being not more than the sealing portion of an outer tube.

It is an object of the present invention to provide a discharge lamp with a space between an inner and outer tube, and a gas disposed in that space which changes the pressure or thermal insulation in that space depending on the temperature.

It is yet another object to reduce the leakage current produced when a discharged lamp is attached to a luminaire.

Briefly stated, A low-pressure mercury vapor-filled discharge lamp has a glass arc tube and a glass outer tube disposed coaxially with the arc tube forming a space therebetween. A gas is disposed in the space. The inner tube contains a gas in which a gas discharge can be maintained. The inner surface of the inner tube is coated with a light-emitting phosphor. A first seal at teach end hermetically seals the inner tube. A second seal near each end seals the inner tube to the outer tube. The inner tube further contains a pair of cathodes coupled to a Dumet wire. The Dumet wire extends from the interior of the inner tube to the outside of the lamp structure.

The invention includes a sealed tubular body which is provided with a pair of cold cathodes respectively disposed at the two ends of the tubular body and sealed therein. The sealed tubular body also has a translucent thermal insulation means around the sealed tubular body, wherein the sealed tubular body is adapted to attain, without a temperature compensating means, tube surface luminance of more than 50% of the stable luminance within 60 seconds after the lighting is actuated at an ambient temperature of approximately 0° C. The outer diameter of the sealed tubular body is not more than 8 mm. The load applied to the tube wall is at least 0.04 W/cm$^2$ when the electric power input thereto is not more than 3 W. With the configuration as above, even when the electric power input to the tubular body is not more than 3 W, at least 0.04 W/cm$^2$ of a tube wall load is ensured, so that the luminance is increased. In addition, since the lamp has a sealed tubular body having an outer diameter of not more than 8 mm, the invention permits a compact construction of a lamp so that light loss is reduced to a minimum when the lamp is mounted on a luminaire or the like. Even in low ambient temperatures, the invention ensures rapid increase of the tube surface luminance and lighting without the danger of decrease in the lamp efficiency.

According to another feature, the invention includes an inner tube with an inner diameter of not more than 3 mm with cold cathodes sealed therein at the ends. An outer tube encompasses the inner tube. The pressure in the space between the inner tube and the outer tube is reduced to a value such that the input voltage when the lamp is lit under the condition of the load applied to the tube wall being approximately 0.1 $W/cm^2$ at ambient room temperature is at least 10% lower than in a case where a lamp having only an inner tube is lit. Constructed this way, the invention permits a compact construction of a lamp so that light loss is reduced to a minimum when the lamp is mounted on a luminaire or the like. The lamp can be lit without the danger of decrease in the lamp efficiency.

According to another feature, the invention includes an inner tube with an inner diameter of not more than 3 mm and having cold cathodes disposed at the ends of the inner tube and sealed therein. An outer tube encompasses the inner tube. The pressure in a coaxial space between the inner tube and the outer tube is reduced to a value such that the electric power input to the lamp to produce the maximum efficiency luminosity (1 m/W) when the lamp is lit in room temperature atmosphere is at least 15% lower than in a case where a lamp having only an inner tube is lit. Constructed in this way, the invention permits a compact construction of a lamp so that light loss can be minimized when the lamp is mounted on a luminaire or the like and the lamp can be lit without the danger of a decrease in the lamp efficiency.

According to yet another feature, the invention includes an inner tube hermetically containing a discharge medium principally comprised of mercury and having cold cathodes disposed at the ends of the inner tube and sealed therein. An outer tube having an outer diameter of not more than 8 mm encompasses the inner tube with a space of not more than 1 mm therebetween. The outer tube is hermetically sealed at a pressure not exceeding 1000 Pa. In this way, the invention is capable of reducing light loss to a minimum when the lamp is mounted on a luminaire or the like. Since the two tubes are sealed together with the pressure in the space being not more than 1000 Pa, the inner tube is maintained at an appropriate temperature because of using thermal insulation resulting from free-molecular thermal conduction. Therefore, the lamp can be lit without the danger of decrease in the lamp efficiency even in low ambient temperature.

According to yet another feature of the invention, when the load applied to the tube wall is less than 0.1, i.e. $W/S<0.1$, the condition $P<0.3\times m$ is fulfilled, wherein S [$cm^2$] represents the surface area of the inner tube, P [Pa] the pressure in the space 5, W [W] the power input to the lamp and m the molecular weight of the principal filler gas in the space. Because of this feature, the invention is capable of maintaining radiation of heat from the surface of the inner tube reduced to a minimum and preventing a decrease in the efficiency of the lamp even when the power input to the lamp is relatively low.

According to yet another feature of the invention, when the load applied to the tube wall is at least 0.1, i.e. $W/S>0.1$, the condition $0.3\times m \leqq P \leqq 2\times m$ is fulfilled, wherein P [Pa] represents the pressure in the space, S the surface area of the inner tube and m the molecular weight of the principal filler gas in the space. Because of this feature, the invention reduces loss resulting from discharge of heat due to the radiation and controlling the amount of radiation from the surface of the inner tube to an appropriate level, thereby preventing a decrease in the efficiency of the lamp even when the power input to the lamp is relatively high.

According to yet another feature of the invention, the inner and outer tubes are made of glass and integrally sealed and welded to each other by means of glass welding at the ends thereof. Therefore, without the need of a member of a different material, the invention ensures sufficient sealing capability while reliably maintaining the sealing and positional relationship between the inner tube and the outer tube. The invention is also increases the mechanical strengths of the inner tube and the outer tube and, therefore, permits the thickness of each tube to be reduced.

According to yet another feature of the invention, the inner and outer tubes are made of glass or glasses having an identical thermal expansion coefficient, the thicknesses of the glasses of the inner tube and the outer tube independently ranging from 0.1 mm to 0.5 mm. Since the invention has a double-tube structure, it is about twice as strong as a structure which omits an outer tube. Glass having a thickness outside said range is not desirable, because a tube made of glass which is thinner than 0.1 mm is not practical to use, while a tube having an outer diameter of less than 8 mm and made of glass which is thicker than 0.5 mm is difficult to produce. The configuration according to the invention also prevents breakage of an inner tube and an outer tube which may otherwise be caused by the difference in magnitudes of expansion of the inner and outer tubes resulting from the difference in temperature.

According to yet another feature of the invention, the inner tube and the outer tube are respectively provided with sealed portions, wherein the sealed portions of the inner tube are not longer than the sealed portions of the outer tube, i.e, $1_{s1}, \leqq 1_{s2}$, where $1_{s1}$ represents the length of each sealed portion of the inner tube and $1_{s2}$ represents the length of each sealed portion of the outer tube. When the outer tube is heated and welded to the inner tube, tensile stress is generated on the inner tube. At that time, in cases where the inner tube has tiny flaws called Griffith's flaws, the tensile force tends to form cracks on the inner tube. Peeling caused by the stress that works on the interface of the inner tube and the outer tube often results in insufficient heating and formation of cracks. If the tubes are welded together under atmospheric pressure in the state that the pressure in the inner tube is lower than the atmospheric pressure, softened portions of the inner tube are sucked inward. This phenomenon, too, often results in formation of cracks. Providing the above condition of $1_{s1} \leqq 1_{s2}$ prevents cracks, which may otherwise be formed for the reasons described above.

According to yet another feature of the invention, each sealed portion includes an elongated bead stem including a bead whose axial length, along which the tube is sealed, is longer than the diameter of the bead with the axis of the bead at the center. By increasing the lengths of the sealed portions of the inner tube by using elongated bead stems, the invention permits the inner tube to be sealed into the outer tube without unreasonable stress.

According to yet another feature of the invention, the principal filler gas contains either one of or both a stable gas and a noble gas of an element having a greater atomic weight than nitrogen (N). This prevents a decrease in lighting efficiency even in low ambient temperature.

According to yet another feature of the invention, the principal filler gas contains either one of or both xenon (Xe) and krypton (Kr). This improves color temperature and luminance, thereby preventing a decrease in lighting efficiency even in low ambient temperature.

According to yet another feature of the invention, a substance which changes pressure through a change in temperature is sealed in the space between the inner and outer tubes ends the pressure of the substance changes with a change in temperature, the insulation capacity of the space changes accordingly. Thus, the invention is capable of preventing a decrease in efficiency due to insufficient thermal insulation in the low power range at a low temperature, and also prevents saturation of light output in a large power range, which may otherwise be caused by increase in temperature resulting from excessive thermal insulation.

According to yet another feature of the invention, said substance contains, as its principal component, at least one of the substances selected from a group consisting of mercury, mercury compounds, iodine, bromine, water, iodine compounds and bromine compounds. Inclusion of such a substance reduces the vapor pressure, thereby improving the thermal insulation capability at a low temperature, and increases the vapor pressure at a high temperature, thereby reducing the thermal insulation and preventing excessive thermal insulation and overheating at high ambient temperature.

According to yet another feature of the invention, the outer tube has an outer diameter within twice the outer diameter of the inner tube and a wall thickness within 10% of the outer diameter of the outer tube. Even if the outer tube is thin, with an outer diameter of not more than 4 mm, the invention ensures a high lamp luminance and improved luminous flux rising characteristics when the temperature is low.

According to yet another feature, the invention includes a light conducting plate whose thickness exceeds the outer diameter of the outer tube ends. The light conducting plate has a thickness greater than the outer diameter of the outer tube. The invention permits flux of light radiated from the outer tube to be efficiently directed to the light conducting plate, thereby increasing the luminance efficiency.

According to yet another feature, the invention includes an inner tube which has a total length of not more than 120 mm, is adapted to receive electric power of not more than 1.5 W., contains a discharge medium principally comprised of mercury sealed within the inner tube, and has a pair of electrodes coated with $BaAl_2O_4$. The electrodes are respectively disposed at the two ends of the inner tube and sealed therein. An outer tube encompasses the inner tube with a space of not more than 1 mm therebetween and hermetically welded to the inner tube with a pressure in the space of not more than 1000 Pa. By using a pair of electrodes coated with $BaAl_2O_4$, the invention prevents a decrease in efficiency in a low ambient temperature.

According to yet another feature of the invention, argon (Ar) gas is sealed in the space as the principal filler gas at a pressure ranging from 4 Pa to 10 Pa, the argon gas occupying at least 95% of the entire gas that fills the space under the conditions that the outer diameter of the outer tube is 2.6 mm, the outer diameter of the inner tube 1.8 mm, the radial distance between the inner tube and the outer tube is 0.1 mm, and the length of the lamp is 100 mm and the power input to the lamp is in a range from 0.5 W to 1 W. With the configuration as above, the invention prevents a decrease in efficiency in low ambient temperature.

According to yet another feature of the invention, the inner tube is adapted to be lit at a frequency of not lower than 60 kHz with a lamp current of not more than 5 mA. The presence of the outer tube enables the distance between the inner tube, which is the principal component where electric discharge takes place, and another member, for example a reflecting plate of an apparatus on which the lamp is mounted, to be greater than the minimum required distance without the presence of the outer tube. This reduces the danger of current leakage.

According to yet another feature, the invention includes an apparatus body on which the low-pressure mercury vapor-filled discharge lamp is adapted to be mounted.

According to yet another feature, the invention includes a display means to be exposed to radiation from said luminaire.

According to an embodiment of the invention, there is provided a low-pressure mercury vapor-filled discharge lamp comprising, an inner portion having a first gas, at least two electrodes, and a phosphor disposed within it, a first and second seal, an outer portion having a thickness of less than 0.1 mm and having an outer diameter of less than 8 mm, the first seal hermetically sealing the gas and the phosphor in the inner tube, the second seal coaxially sealing the outer portion to the inner portion and defining a space therebetween, a second gas disposed within the space, and a pair of Dumet wires each coupled to a respective cathode and extending through the seal to an outside of the lamp.

According to a feature of the invention, there is provided a fluorescent lamp comprising, an inner tube, the inner tube including means for producing a gas discharge therein, an outer tube sealed at its ends to the inner tube, a space between the inner tube and the outer tube, at least one gas in the space, a partial pressure of the gas in the space being effective to vary a thermal conductivity in the space over values suitable for maintaining a brightness of the fluorescent lamp over an ambient temperature range.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 1(*b*) is a schematic view of the lamp and lighting circuit according to the present invention.

DETAILED DESCRIPTION OF THE PREFERRED EMBODIMENT

Figure 1A:
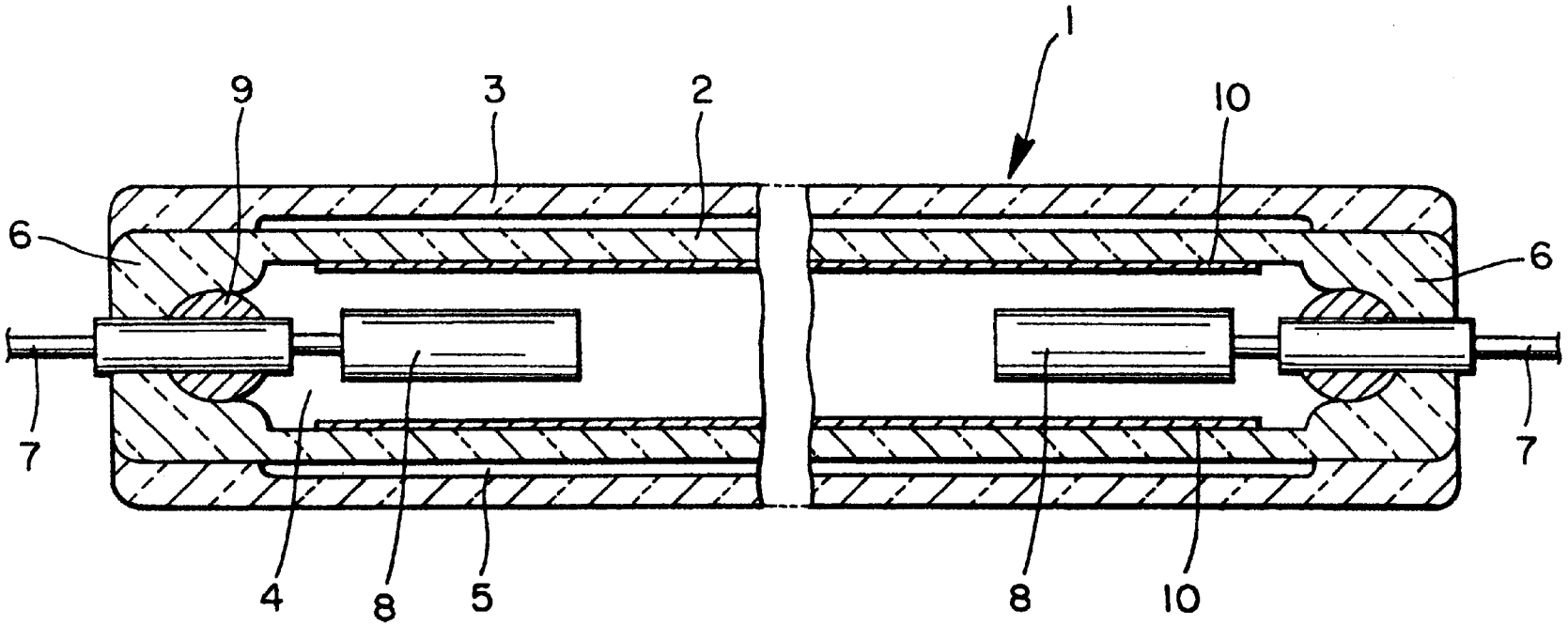
FIG. 1(*a*) is a transverse cross section of a low-pressure mercury vapor-filled discharge lamp according to the present invention.
Figure 1B:
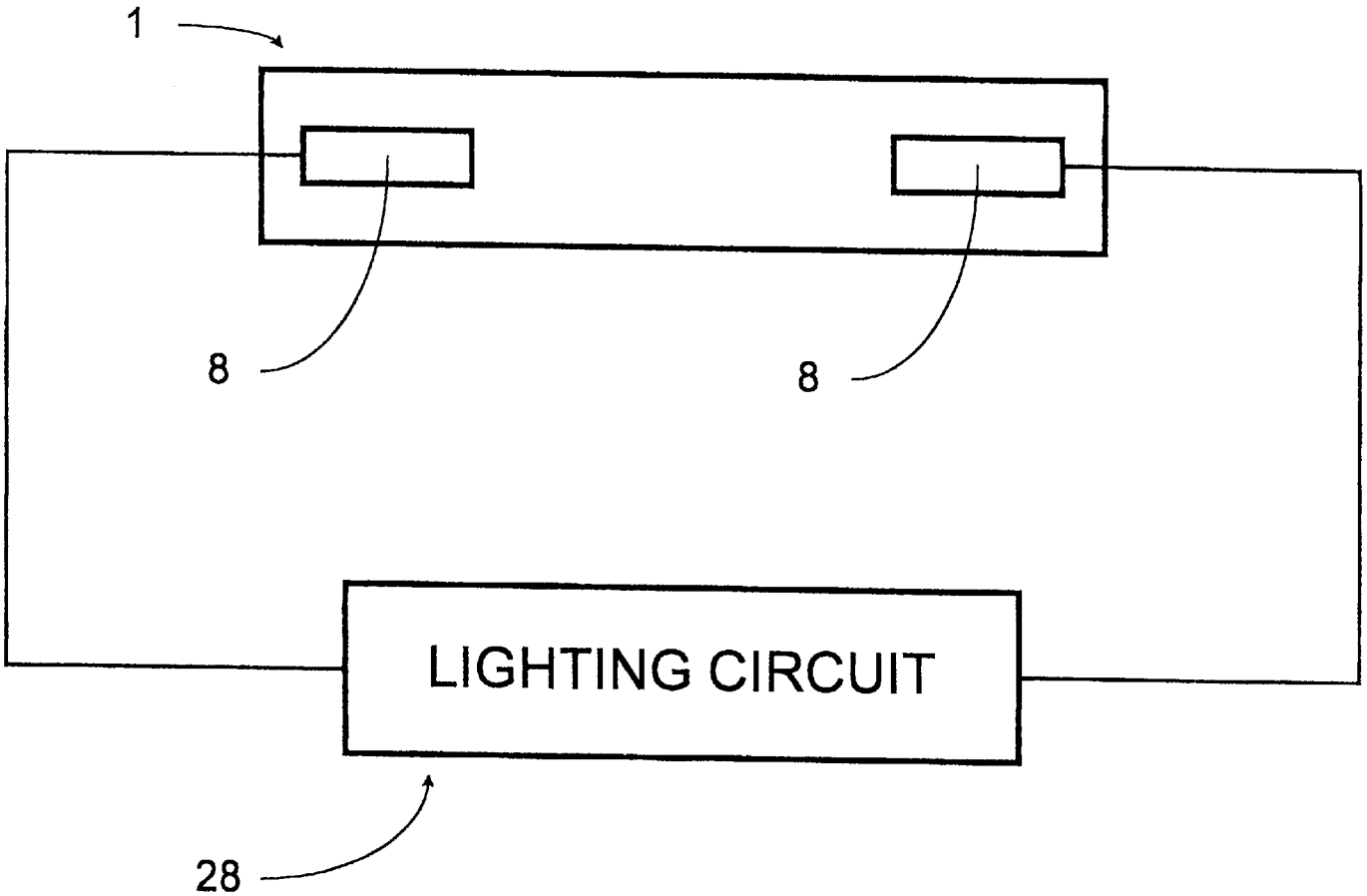
Figure 2:
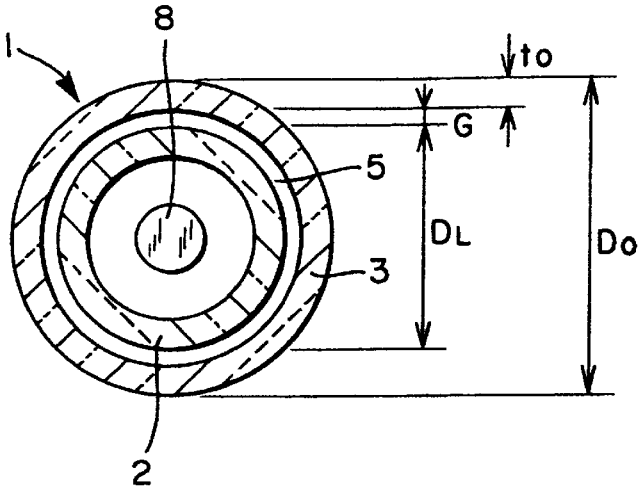
FIG. 2 is a transverse cross section of said low-pressure mercury vapor-filled discharge lamp.

Referring now to FIG. 1 and FIG. 2, there is shown generally at 1 a low-pressure mercury vapor-filled discharge lamp. Both figures illustrate merely the concept of the lamp and, therefore, do not intend to show a detailed form or accurate dimensions. Low-pressure mercury vapor-filled discharge lamp 1 has an arc tube 2 which is a cylindrical straight inner tube made of boro-silicate glass (Product No. 7050 manufactured by Corning), and an outer tube 3 made of the same or a similar boro-silicate glass as that of arc tube 2. Outer tube 3 is disposed coaxially with arc tube 2, with a space 5 formed between arc tube 2 and outer tube 3. A discharge path 4 is formed in arc tube 2, and seal portions 6 at which arc tube 2 and outer tube 3 are integrally sealed, are respectively formed at the ends of the double tube consisting of arc tube 2 and outer tube 3. The boro-silicate glass manufactured by Coming as Product No. 7050 has a thermal expansion coefficient of $46\times10^{-7}$° C. Arc tube 2 and outer tube 3 may be made of glass of any other type, such as soda lead glass, soda lime glass, lead glass or hard glass.

Each of seal portions 6 at the ends of the double tube consisting of arc tube 2 and outer tube 3 is provided with a cold cathode 8 and a bead glass 9. Each cold cathode 8 is a cylindrical nickel electrode of a field emission type and is connected to a Dumet wire 7 which consists of a single wire. The low-pressure mercury vapor-filled discharge lamp 1 has a total length of 200 mm with arc tube 2 having a thickness of 0.2 mm and an outer diameter $D_L$, of 2.4 mm. The inner surface of arc tube 2 is coated with a three band phosphor either directly or with a protective coat therebetween. The arc tube 2 is filled with noble gas, such as neon or the like at $1\times10^4$ Pa and mercury vapor.

Further, arc tube 2 has an inner surface area S of approximately 10 $cm^2$. Outer tube 3 has a thickness $t_o$ of 0.3 mm and an outer diameter $D_o$ of 3.6 mm. The length of each Dumet wire 7 in seal portion 6 is 2 mm in order to prevent decrease in efficiency. That is to prevent formation of a coldest portion, which may otherwise be formed by conduction of heat generated at the corresponding cold cathode 8 in the vicinity of the cathode.

Since the lamp has a double-tube structure having arc tube 2 and outer tube 3, the lamp is about twice as strong as one which does not have an outer tube 3. However, a tube wall having a thickness outside a range between 0.1 mm and 0.5 mm in not desirable, because a tube whose wall is thinner than 0.1 mm is not practical to use, while a tube having an outer diameter of less than 8 mm and thicker than 0.5 mm is difficult to produce.

Setting the outer diameter and the wall thickness of outer tube 3 within twice the outer diameter of arc tube 2 and within 10% of the wall thickness of inner tube 2 respectively, enables the diameter of the lamp to be reduced while ensuring sufficiently efficient light radiation.

The same effect can be achieved if the length of Dumet wire 7 in each seal portion 6 does not exceed 5 mm. Of the entire length of a Dumet wire 7, the supported portion includes the portion outside outer tube 3 exposed to the outside air and the portion bonded to outer tube 3 by welding or any other appropriate way that permits thermal conduction. In cases where a Dumet wire 7 is supported at a plurality of such portions, the length of the supported portion of Dumet wire 7 is a total of the lengths of such portions.

A phosphor 10 of a three band type is provided on the inner surface of arc tube 2, wherein $(SrCaBa)_5(PO_4)_3Cl$:Eu may be used for blue, $LaPO_4$:Ce,Tb for green and $Y_2O_3$:Eu for red.

The radial dimension G of the space between arc tube 2 and outer tube 3 is 0.2 mm, and the vacuum or the pressure of the gas that fills space 5 (hereinafter simply referred to as the pressure) should not exceed 1000 Pa (approximately 7.5 Torr), desirably 100 Pa or less. It may be high vacuum with the pressure as low as 1 Pa or less as in the case of the present embodiment. Although the radial dimension of space 5 is 0.2 mm according to the embodiment, no problem will arise as long as the dimension is limited to approximately 1 mm. Should the dimension of space 5 exceed 1 mm, however, not only does this make the entire diameter of low-pressure mercury vapor-filled discharge lamp 1 excessively large, but other problems also arise. For example, in cases where low pressure mercury vapor-filled discharge lamp 1 is mounted on a luminaire or the like, if the distance between arc tube 2 and the object of light incidence exceeds 1 mm, a corresponding increase in light loss occurs. In order to facilitate starting by generating exo-electrons, an $\alpha$ alumina may be provided on the inner surface of arc tube 2, at locations near cold cathodes 8,8.

A low-pressure mercury vapor-filled discharge lamp 1 having the above configuration may be formed as follows: first, arc tube 2 is filled with a discharge medium principally comprised of mercury (Hg), together with one or more noble gases, and then sealed by fitting bead glass 9 of a Dumet wire 7 to each end of the tube. Thereafter, an end of arc tube 2 is aligned with one of the two ends of outer tube 3. The end portions of arc tube 2 and outer tube 3 are melted using a gas burner, thereby sealing the portion of Dumet wire 7 where bead glass 9 is located. Then, impure gas in space 5 is discharged by heating the area to a high temperature, e.g. more than 400° C., while discharging the gas by means of the vacuum system. The end of arc tube 2 at the exhaust side is heated from the outside of outer tube 3, thereby sealing together arc tube 2 and outer tube 3 principally around Dumet wire 7. Finally, the formation of low-pressure mercury vapor-filled discharge lamp 1 is completed by cutting arc tube 2 and outer tube 3 at both ends.

Referring to FIG. 1(*b*), a lighting circuit 28 adapted to produce an output voltage waveform of 40 kHz or more, with voltage ranging from approximately 400 to 500 V, and lamp current of approximately 5 mA or less and a lamp input power of approximately 2 W is connected to cold cathodes 8,8. The circuit is so adapted that a load of at least 0.04 $W/cm^2$ is applied to the tube wall even if the electric power input is less than 3 W.

Figure 3:
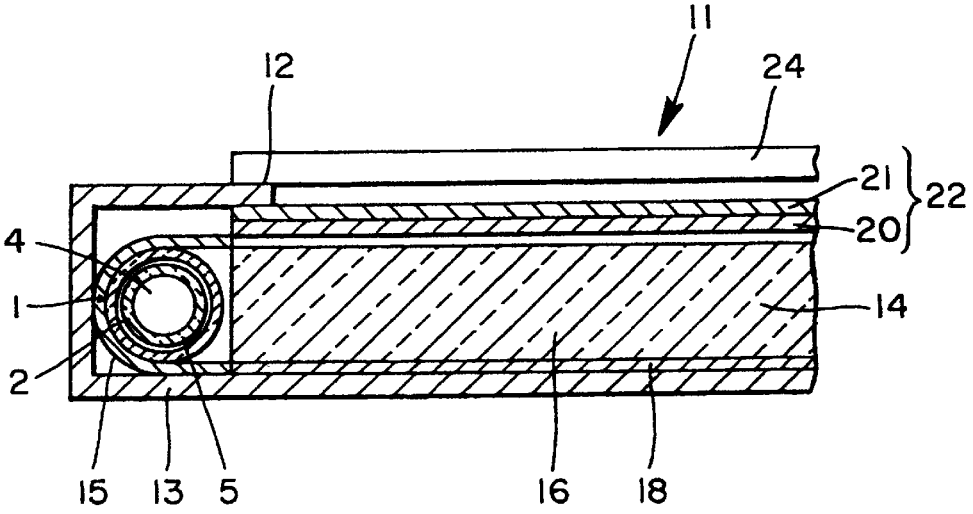
FIG. 3 is a sectional view of a liquid crystal display device according to the invention.

Referring now to FIG. 3, a liquid crystal display, shown generally at 11, incorporates a low-pressure mercury vapor-filled discharge lamp according to the embodiment described above. Liquid crystal display (LCD)11, includes a thin, box-shaped case 13 having an opening 12 on the front side for radiating light. A subsurface illuminating unit 14 serving as the illuminating device is contained in case 13. The subsurface illuminating unit 14 includes a low-pressure mercury vapor-filled discharge lamp 1, in the vicinity of which a reflecting mirror 15 that also serves as a proximity conductor is disposed. The reflecting mirror 15 is film coated with a layer of silver, which is formed by means of vapor deposition, and wrapped around outer tube 3 with one of the ends being open. In the direction of radiation by reflecting mirror 15, a light conducting plate 16 made of an acrylic resin is disposed in such a position as to face opening 12 of case 13. A flat reflecting plate 18 is disposed behind light conducting plate 16, and a light controlling means 22 including a diffusion plate 20 and a light condensing plate 21 is disposed between conducting plate 16 and opening 12 of case 13. Further, a liquid crystal display unit 24 serving as a display means is disposed in front of opening 12 of case 13.

In use, voltage is applied across the path between cold cathodes 8,8 through the lighting circuit, thereby actuating and lighting the lamp. As a result, electric discharge between cold cathodes 8,8 excites the mercury vapor, thereby exciting ultraviolet radiation with a wavelength of 254 nm. This causes, light to be emitted by the three band phosphor and reflected by reflecting mirror 15 in the direction of light conducting plate 16. The light conducted by light conducting plate 16 is radiated by diffusion plate 20 and light condensing plate 21 to liquid crystal display unit 24 from the back side to display information on liquid crystal display unit 24.

Figure 4:
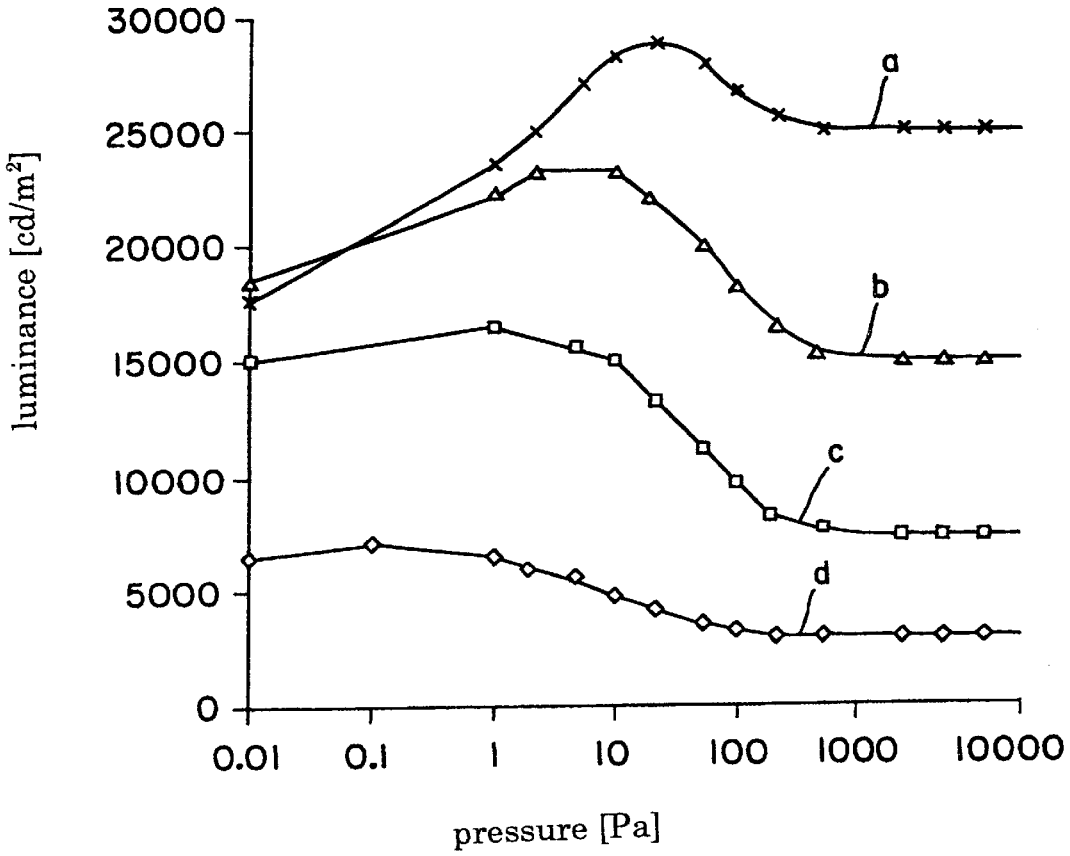
FIG. 4 is a graph showing the relationship between pressure and luminance.

FIG. 4 is a graph showing the relationship between pressure and luminance. The lines a, b, c and d represent values when electric power input to the lamp (lamp input power) W divided by inner surface S of arc tube 2 (W/S) is 0.2, when W/S is 0.15, when W/S is 0.1, and when W/S is 0.05 respectively. W/S is equivalent to the load applied to the tube wall. In every case, results of the experiment confirm that luminance increases when the pressure in space 5 is reduced to approximately 1000 Pa (7.5 Torr) or less. More favorable results were obtained when the pressure was less than 100 Pa.

Figure 5:
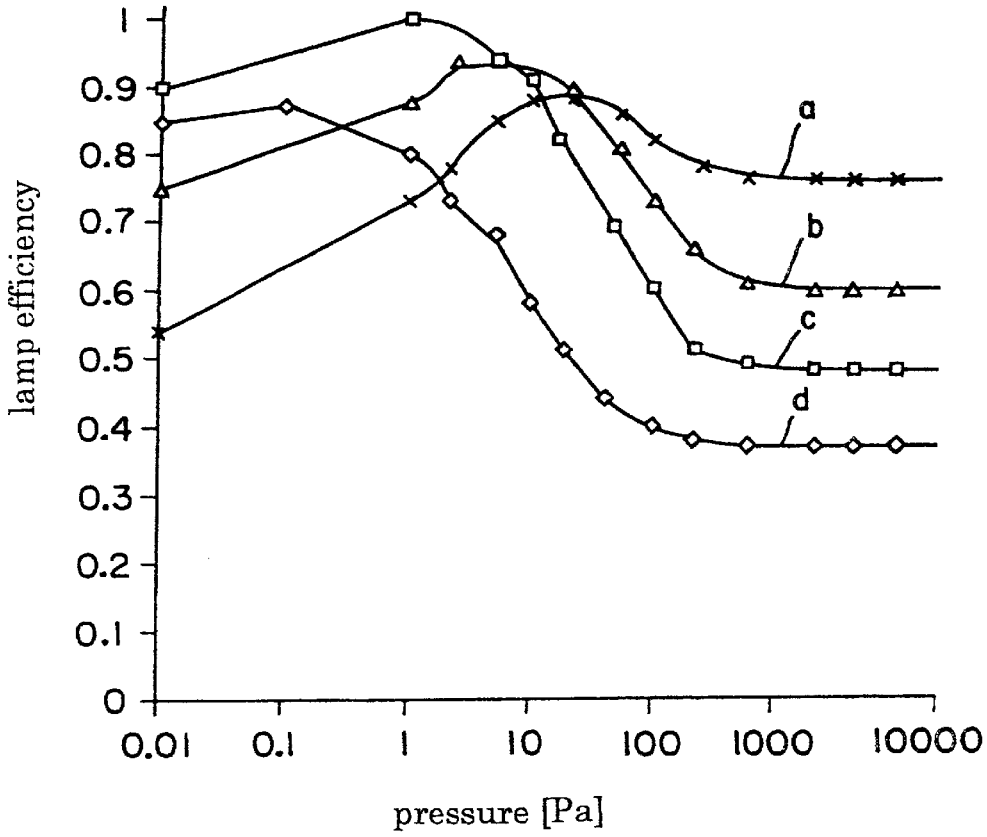
FIG. 5 is a graph showing the relationship between pressure and lamp efficiency.

FIG. 5 is a graph showing the relationship between relative values representing lamp efficiency and pressure. In FIG. 5, the lines a, b, c and d represent values when the load applied to the tube wall W/S [W/cm$^2$], i.e. lamp power input W, per unit inner surface area S of arc tube 2, is 0.2, when W/S is 0.15, when W/S is 0.1, and when W/S is 0.05 respectively. In every case, it has been found that the efficiency increases when the pressure in space 5 is reduced to approximately 1000 Pa (7.5 Torr) or less.

In cases where the degree of vacuum is increased by reducing the pressure in space 5 as shown in FIGS. 4 and 5, applying a great load W/S to the tube wall generates a large quantity of heat. This exceedingly increases the temperature of arc tube 2 and results in efficiency reduction. In cases where the pressure is decreased to less than 0.1 Pa, decrease in lamp efficiency is especially conspicuous.

Figure 6:
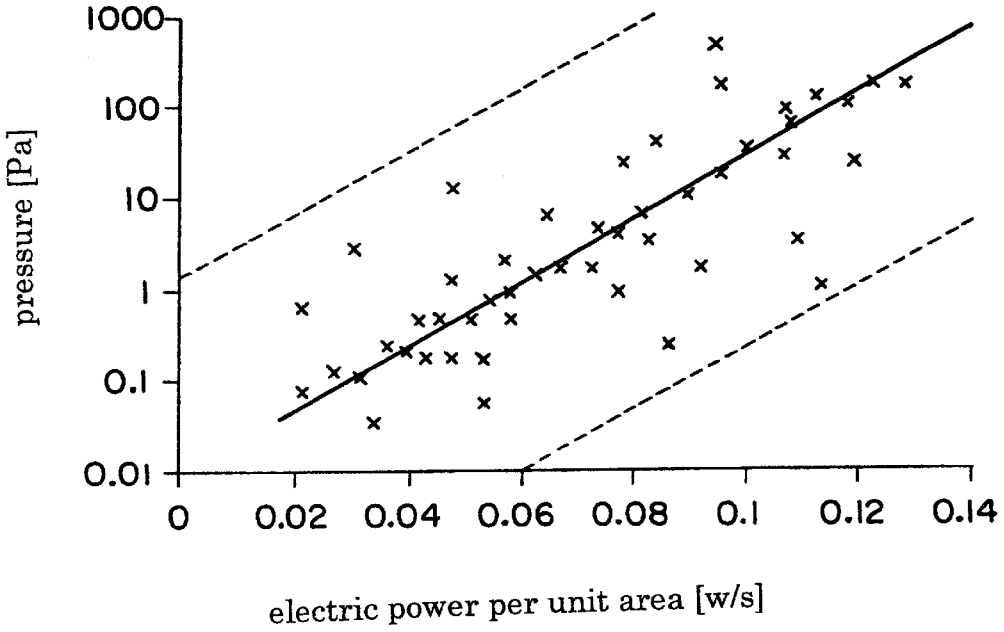
FIG. 6 is a graph showing the relationship between electric power per unit area and pressure.

Referring now to FIG. 6, when the relationship between load W/S to the tube wall and pressure in space 5 is included in consideration, the relationship which produces the maximum luminance can be represented by the following equations:

$$P=\exp[(j1\cdot W/S)\times j2]$$

$$J1=80$$

$$10^{-5}<J2<1$$

wherein P represents pressure. In FIG. 6, each point plotted with an X represents the value of pressure [Pa] where each embodiment example X of the invention lit at a load W/S to the tube wall, produced the maximum luminance. The solid line represents the proximity line of the points X.

As shown In Table 1, given that the luminance is 100 at the time when the tube walls of arc tube 2 and outer tube 3 are both 0.2 mm thick, the thicker light conducting plate 16, the more its surface luminance decreases. On the other hand, since the lamp has a double-tube structure including arc tube 2 and outer tube 3, the lamp is about twice as strong as those which do not have an outer tube 3. However, in cases where the wall of outer tube 3 is thinner than 0.1 mm, it is not practical to use. An exceedingly thick tube is not recommendable either, because a tube having a wall thicker than 0.5 mm and an outer diameter of less than 8 mm is not desirable in respect to efficiency of light usage as well as being difficult to produce. Therefore, it is preferable that arc tube 2 and outer tube 3 both have a thickness ranging from 0.1 mm to 0.5 mm.

TABLE 1

| wall thickness [mm] | | outer diameter [mm] | | relative values of light conducting |
|---|---|---|---|---|
| glass arc tube | outer tube | glass arc tube | outer tube | plate of surface luminance |
| 0.3 | 0.5 | 2.6 | 4 | 75 |
| 0.3 | 0.3 | 2.6 | 4 | 85 |
| 0.2 | 0.2 | 2.0 | 3 | 100 |
| 0.5 | 0.5 | 2.8 | 4 | 60 |

Since each cold cathode 8 is supported at a seal portion 6 by a single Dumet wire 7, and seal portion 6 integrally seals arc tube 2 and outer tube 3, this configuration produces less distortion compared with a configuration where each cold cathode is supported by two or more wires. Accordingly, there is less danger of damage to seal portion 6 or other members.

Figure 7:
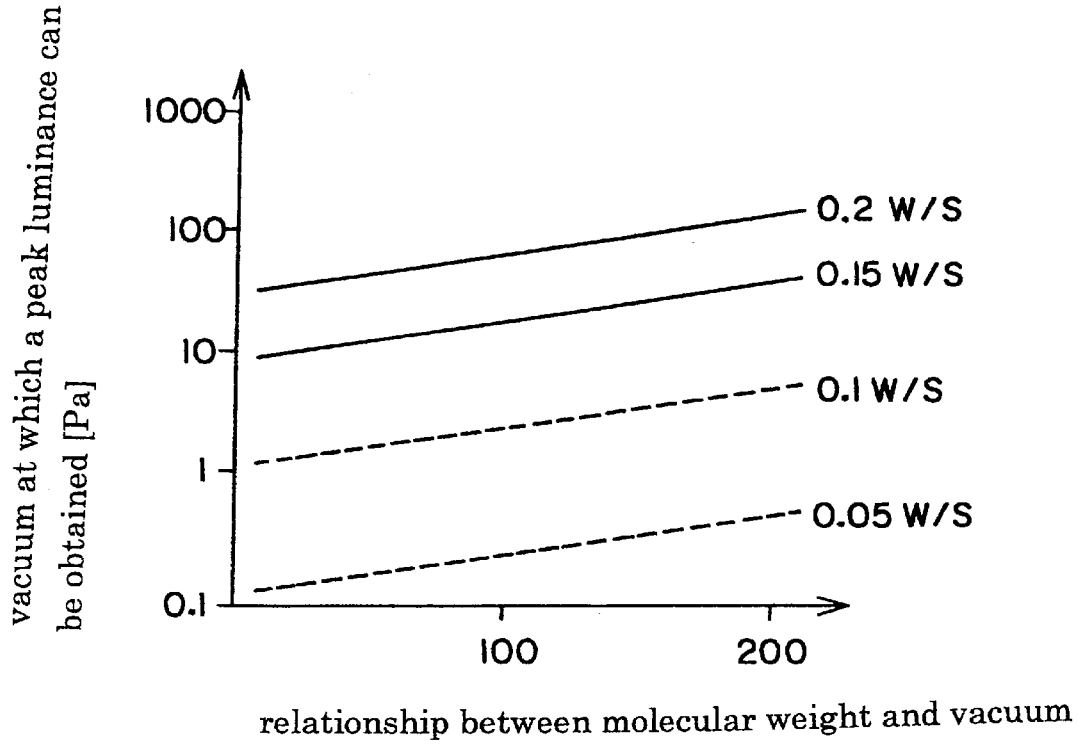
FIG. 7 is a graph showing the relationship between vacuum at which a peak luminance can be obtained and the relationship between molecular weight and vacuum.

With regard to the relationship between molecular weight and a degree of vacuum at which the maximum luminance can be obtained, it has been found that the degree of vacuum at which the maximum luminance can be obtained increases with the increase of molecular weight as shown in FIG. 7. This is because the greater the molecular weight, the more effective the heat insulation. From these results, relations between the optimum degrees of vacuum for respective electric power and molecular weights have been found.

Having a molecular weight about four times that of nitrogen ($N_2$) gas, Krypton (Kr) gas (having a molecular weight of 83.8) and xenon (Xe) gas (having a molecular weight of 131.3) have superior thermal insulating capacities. When $0.1<(W/S)<0.3$, krypton gas and xenon gas are both capable of achieving sufficient effect at a pressure of approximately 100 Pa. Although it is extremely difficult to control a vacuum at approximately 1 Pa during the production process, sufficient control of vacuum, which enables the production with stable quality control, is possible when the pressure is around 100 Pa. Krypton or xenon used for this purpose may contain residual water ($H_2O$), which may be used to discharge heat from the ends. The pressure of steam of residual water increases with increase in temperature. Inclusion of residual water results in higher thermal conductivity and more effective heat radiation. Another example of a stable gas with a greater molecular weight is $SiBr_4$, which has a molecular weight of 347.6.

Figure 8:
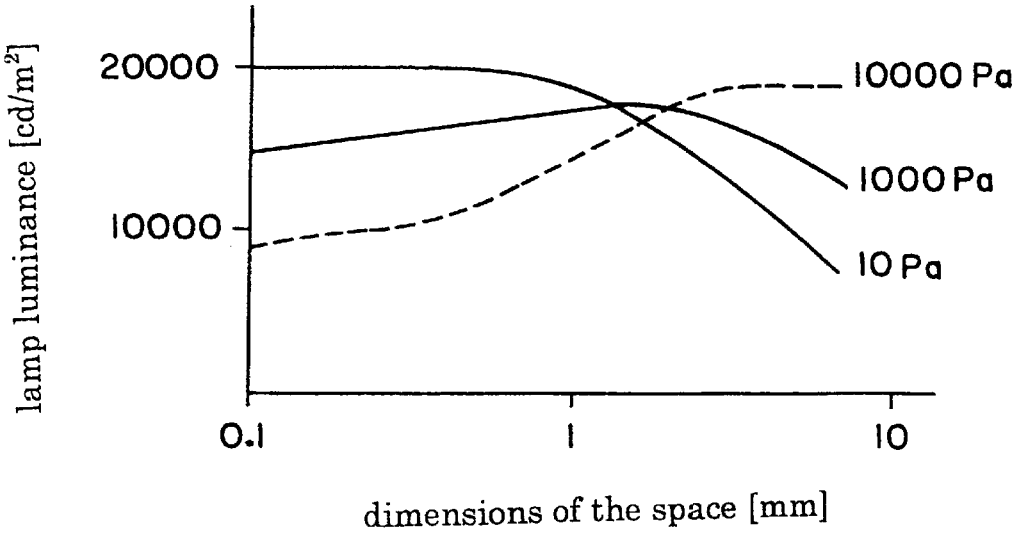
FIG. 8 is a graph showing the relationship between dimensions of the space and lamp luminance.

Various outer tubes 3 were tested under the condition that the outer diameter of arc tube 2 was set at 2.0 mm. As shown in FIG. 8, in cases where the dimension of space 5 exceeds 1 mm, the luminance of the lamp increased until the pressure reached 10000 Pa because of heat retaining capability. At 10 Pa, however, the luminance decreased because arc tube 2 became too hot. On the other hand, in cases where the dimension of space 5 was less than 1 mm, the luminance of the lamp increased due to heat insulation capability resulting from free-molecule thermal conduction in spite of the fact that the space was extremely narrow. Free-molecule thermal conduction comes into effect in cases where the mean free path of molecules in the gas inside the lamp exceeds the distance between molecules. There is no effect observed of free-molecule thermal conduction when the pressure is higher than 100 Pa, especially when the pressure exceeds 1000 Pa, as long as the dimension of the space 5 is 1 mm. Therefore, in such a case, it is necessary to increase the dimension of the space 5 in order to achieve suitable heat insulation effect.

Furthermore, the greater the radial dimension of space 5, the better heat retaining capability and temperature characteristics. In this regard, by limiting the pressure to 1000 Pa or, desirably, 100 Pa or less, the diameter of a low-pressure mercury vapor-filled discharge lamp 1 can be reduced to a size thinner than the thickness of light conducting plate 16 as shown in the embodiment described above. Also the efficiency of light conducting plate 16 in using light emitted from low-pressure mercury vapor-filled discharge lamp 1 can be improved. In other words, the optimal heat retaining effect can be achieved through the heat insulation achieved by free-molecule thermal conduction of space 5.

An on-vehicle display can be composed by providing a display unit which can be mounted on a vehicle, such as a vehicle instrument, instead of an LCD unit of the embodiment described above.

Furthermore, the outer diameter of arc tube 2 is not limited to 3.6 mm; the same effect can be achieved with the outer diameter of 8 mm or less (desirably less than 4 mm).

Reflecting mirror 15 is a film coated with a conductive member such as a metal film by means of vapor disposition. By employing reflecting mirror 15, the embodiment improves usage efficiency of light emitted from a low-pressure mercury vapor-filled discharge lamp 1. Other types of members, such as various synthetic films or plastic members may be used instead of a conductive member.

Although it is preferable that arc tube 2 and outer tube 3 are made of glass of the same type, they may be made of different materials. For example, one may be made of soft glass while the other may be of hard glass.

In a further embodiment, still referring to FIGS. 1 and 2, the total length of a low-pressure mercury vapor-filled discharge lamp 1 is 120 mm, the outer diameter of an arc tube 2 is not more than 3 mm, for example 2.4 mm, the outer diameter of an outer tube 3 is not more than 4 mm, for example 3.4 mm, space 5 is 0.2 mm, and the pressure is not more than 100 Pa.

Each cold cathode 8 serving as an electrode is formed by means of thermal spraying on nickel of an electron emissive material, i.e. $Ba_2AlO_4$. The conductive metal which may be $LaB_6$ or at least one selected from among W, Fe, Co and Ni, with the proportion of the materials being in the range from about 1.5:1 to about 2:1. Power input to the low-pressure mercury vapor-filled discharge lamp 1 is 1.5 W or less.

The second embodiment described above, is free from the danger of gas loss and has a superior thermal insulation capability. As a result of using cold cathodes 8 described above, increase in temperature around cold cathodes 8 becomes faster so that the pressure of mercury vapor can be maintained at a sufficiently high level. Although cold cathodes made solely of nickel are capable of increasing temperature, they cause the temperature to increase so high that the luminance efficiency is reduced. In cases where the total length of low-pressure mercury vapor-filled discharge lamp 1 is less than 120 mm, the temperature of cold cathodes 8 affects the entire lamp.

Tests conducted to compare lamps according to this invention with comparison examples, i.e. those using hot cathodes and those using cold cathodes made of a mercury alloy, show that the embodiment achieved sufficient luminance at a an ambient temperature as low as 5° C. and showed no decrease when the temperature was increased to 35° C. The comparison examples using heated cathodes indicated luminance decrease at a temperature below 10° C., and those using cold cathodes made of a mercury alloy indicated luminance decrease at 35° C., although they were sufficiently luminous at a low temperature of 5° C.

While the embodiment described showed cathode voltage drop of 80 V, cold cathodes made of a mercury alloy presented cathode voltage drop of 120 V. In other words, even when the same amount of current flows to these two types of cathodes, the temperature of arc tube 2 in the embodiment is higher. Therefore, in a double-tube structure having an arc tube 2 and an outer tube 3, the embodiment described above is capable of offering improved efficiency in the high-temperature range.

The samples using hot cathodes showed cathode voltage drop of approximately 12 V, the lamp current was 10 mA, electric power consumed to heat the arc tube was 0.18 W compared with 0.4 W according to the above embodiment. For this reason, according to the embodiment of the invention, temperature increase is faster even in the low temperature range so that the coldest portion is rarely formed around a cold cathode 8. Therefore, a lamp according to the invention is more luminous.

When W/S (load applied to the tube wall)<0.1 and P<0.3×m, wherein S [$cm^2$] represents the surface area of arc tube 2, P [pa] the pressure in space 5, W [W] electric power input to the lamp, and m the molecular weight of the principal gas filling space 5, the configuration according to the embodiment is capable of maintaining heat radiation from the surface of arc tube 2 to the minimum, thereby preventing a decrease in lighting efficiency even when the electric power input to the lamp is relatively small. In cases where the load applied to the tube wall is not smaller than 0.1 ($W/S \geqq 0.1$), as long as the condition $0.3 \times m \leqq P \leqq 2 \times m$ is fulfilled, the configuration according to the embodiment is capable of controlling the quantity of heat radiated from the surface of arc tube 2 as well as reducing loss that results from heat discharge caused by heat, thereby preventing a decrease in lighting efficiency even when the electric power input to the lamp is relatively large.

Figure 9:
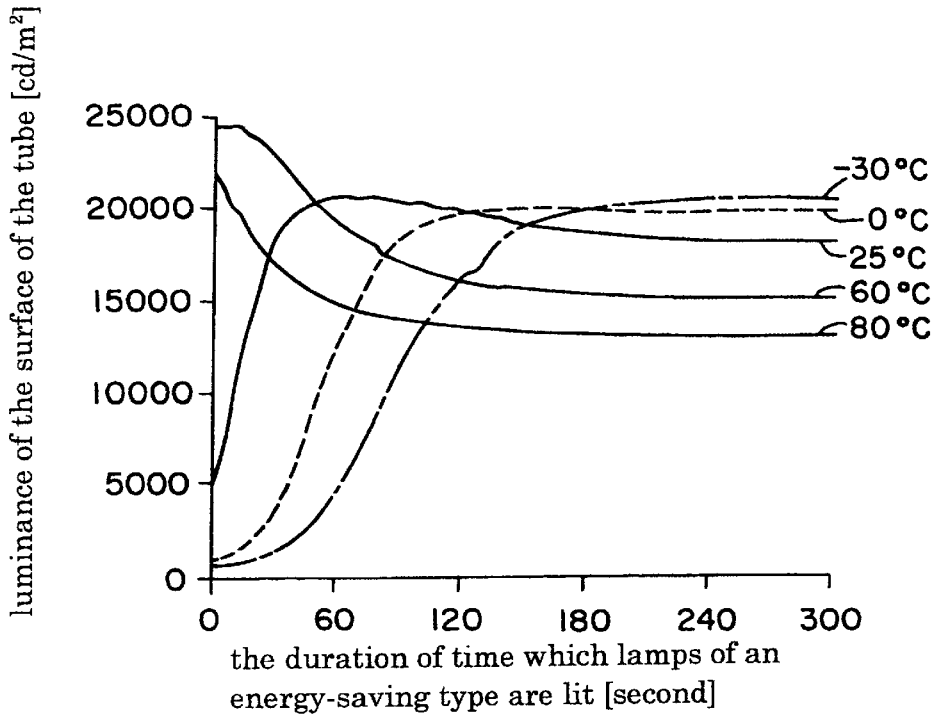
FIG. 9 is a graph showing the relationship between the duration of time while lamps of an energy-saving type are lit and the luminance of the surface of the tubes.
Figure 10:
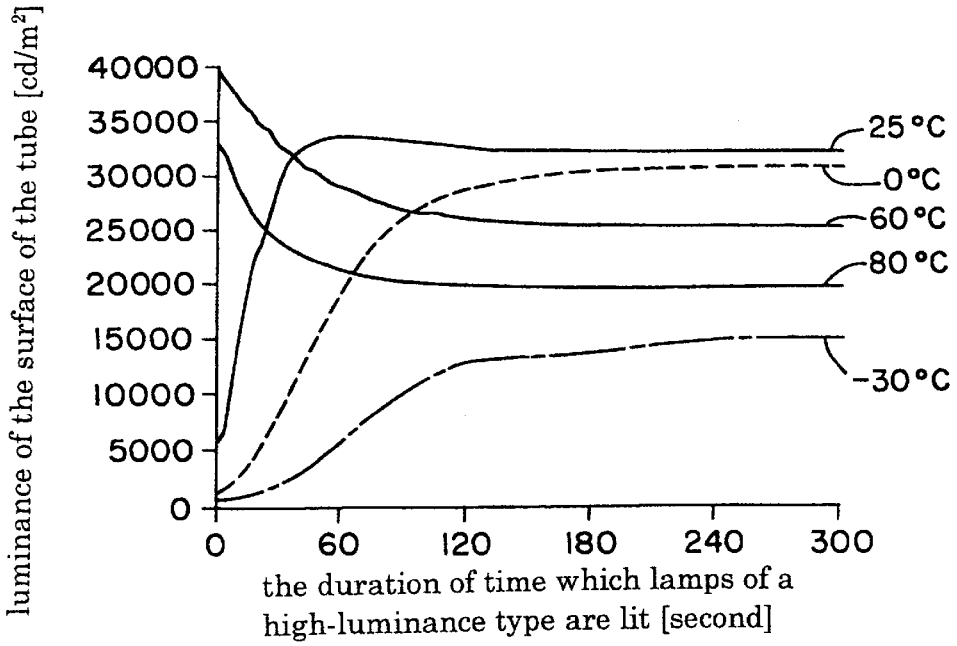
FIG. 10 is a graph showing the relationship between the duration of time while lamps of a high-luminance type are lit and the luminance of the surface of the tubes.

Next, another embodiment of the invention is explained, referring to FIGS. 9 and 10. Each low-pressure mercury vapor-filled discharge lamp shown in FIG., 9, which has characteristics of an energy-saving type, is 160 mm long in total, and is so adapted that its tube surface luminance reaches more than 50% of the stable luminance within 60 seconds after the light is actuated under the conditions that the input power is 0.9 W and the ambient temperature at the lamp is 0° C.

In the same manner as above, each low-pressure mercury vapor-filled discharge lamp shown in FIG. 10, which has characteristics of a high-luminance type, is 160 mm long in total, and so adapted that its tube surface luminance reaches more than 50% of the stable luminance within 60 seconds after the light is actuated under the conditions that the input power is 2.0 W and the ambient temperature of the atmosphere around the lamp is 0° C.

Figure 11:
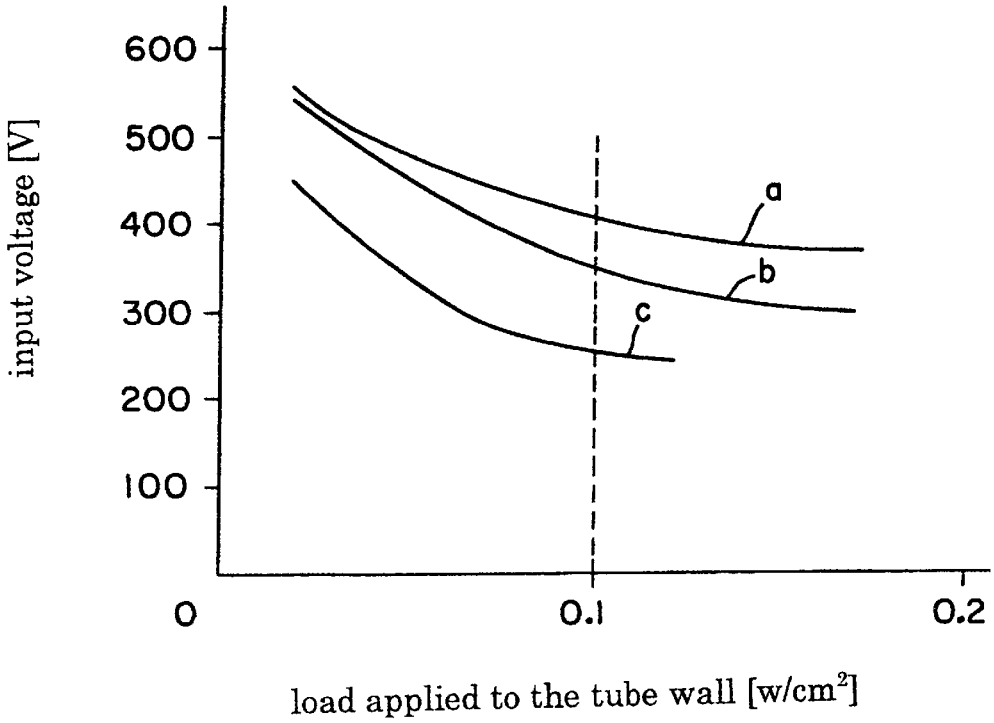
FIG. 11 is a graph showing the relationship between load applied to the tube wall and input voltage.

Experiments were conducted for each embodiment sample by using an arc tube 2 having a length of 140 mm and an inner diameter of 1.6 mm under the conditions of input voltage of 3 W or less and the load applied to the tube wall being 0.04 W/cm$^2$ or more. As shown in FIG. 11, the results of a comparison of cases b (a high-luminance type with an outer tube 3) and c (an energy-saving type) with a case a (a lamp with an arc tube 2 only) indicate that input voltage decreases by approximately 10% in the case b (a high luminance type with arc tube 2 and outer tube 3) and approximately 25% in the case c (an energy saving type with an outer tube 3) compared with the case a (with an arc tube 2 only). With the configuration according to any one of the embodiments described above, input power can be reduced by more than 10%, and as much as approximately 25% or more.

Figure 12:
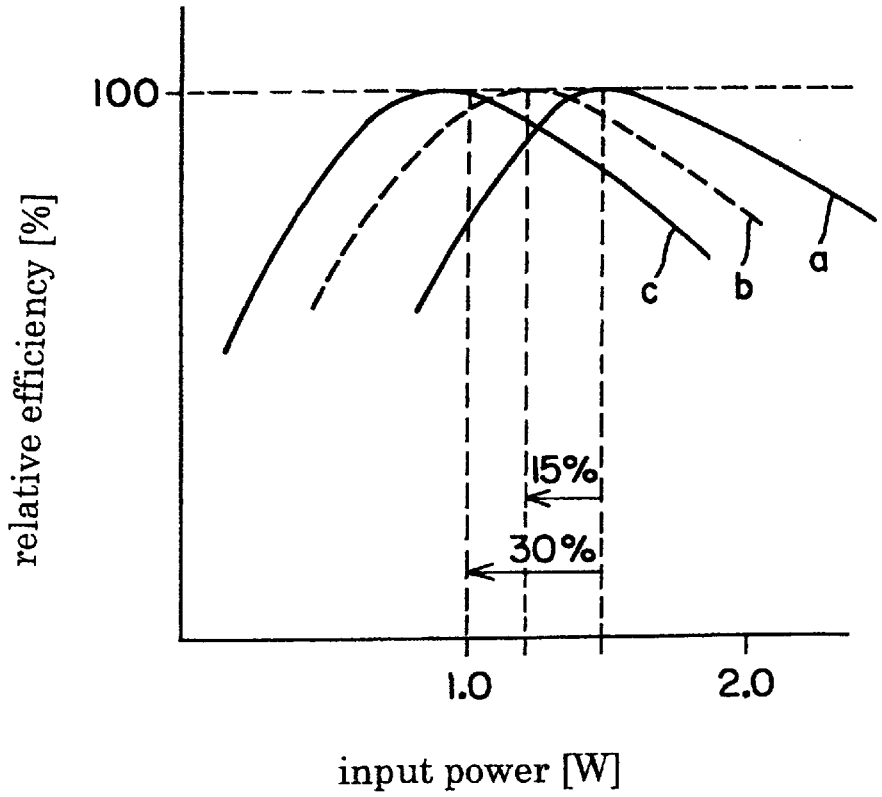
FIG. 12 is a graph showing the relationship between input power and relative efficiency.

Further experiments were conducted using an arc tube 2 having a length of 140 mm and an inner diameter of 1.6 mm under the conditions of input voltage of 3 W or less and the load applied to the tube wall being 0.04 W/cm$^2$ or more. As shown in FIG. 12, the results of comparison of cases b (a high-luminance type with an outer tube 3, wherein the pressure in arc tube 2 is 10 Pa) and c (an energy-saving type with the pressure in arc tube 2 being 1 Pa) with a case a (a lamp with an arc tube 2 only) indicate that input voltage decreases by about 15% in the case b (a high-luminance type with an outer tube 3) and about 30% in the case c (an energy-saving type with an outer tube 3) compared with the case a (with an arc tube 2 only). With the configuration according to any one of the embodiments described above, input power can be reduced by approximately 15% or more.

By including xenon gas in the arc tube, the starting characteristic, the luminance and the color temperature characteristic can be further improved without the need of a heater or other heating means.

More precisely, xenon gas in the arc tube prevents excessive red radiation during the build-up time immediately after the actuation, when the pressure of mercury vapor is still low, or at the time of adjusting the light intensity. Although xenon gas, too, radiates visible red light at 467 nm, its radiation is considerably less than that of neon gas and presents no problem.

When electric discharge is solely conducted with xenon gas, it is a known fact that a large quantity of gas filling a tube often causes contraction of a positive column. Although this phenomenon presents problems such as swell or flickering during the discharge, these problems can be overcome by setting the partial pressure of the xenon gas at 10 Torr or less. However, setting the partial pressure for xenon gas at 1 Pa or less is not recommended, because doing so may cause the xenon gas to be driven into the surface of the glass of arc tube 2 or phosphor 10 and disappear. The xenon gas radiates ultraviolet light in the range from 100 nm to 200 nm, the luminance may be increased by using a phosphor which works with such an ultraviolet radiation.

Discharge gas for the invention, which includes mercury vapor, may contain krypton gas instead of or in addition to xenon gas, wherein the xenon gas and/or the krypton gas may be contained at the respective partial pressures ranging from 1 Pa to 1000 Pa. Although krypton gas, too, radiates visible red light at 587 nm, its radiation is considerably smaller than that of neon gas and presents no problem. The krypton gas also radiates ultraviolet in the range from 100 nm to 200 nm. Luminance may be increased by using a phosphor which is excited by such ultraviolet radiation. In the same manner as in the case of xenon gas, it is necessary to set a partial pressure for krypton gas at 10 Torr or less.

Argon gas radiates visible light in the range from 600 nm to 700 nm, and its ionization pressure is 15.76 eV, which is considerably higher than that of mercury, which is 10.4 eV. Therefore, using argon gas is not recommended because it may cause increase in lamp voltage or other problems.

A low-pressure mercury vapor-filled discharge lamp according to yet another embodiment of the invention is explained hereunder.

According to this embodiment, the substance that fills space 5 is not limited to mercury or a mercury compound. As long as there is a more than 100-fold change in vapor pressure, the same effect can be achieved by using a substance whose vapor pressure increases with a rise in temperature. Examples of such a substance include iodine, a mercury compound and an iodine compound.

The low-pressure mercury vapor-filled discharge lamp 1 in this embodiment is 200 mm long in total and includes an arc tube 2 having an outer diameter of 2.4 mm and an outer tube 3 having an outer diameter of 3.6 mm, The arc tube 2 and outer tube 3 both have a wall thickness of 0.3 mm. The arc tube 2 is filled with noble gas, such as neon (Ne) gas, under pressure of $1\times10^4$ Pa, in addition to mercury vapor. The length of Dumet wire 7 in each seal portion 6 is set at 2 mm, thereby maintaining efficiency by preventing formation of the coldest portion around a cold cathode, which may otherwise be formed by conduction of heat generated by a cold cathode 8 to the vicinity of the cold cathode. However, the same effect can be achieved as long as the length of Dumet wire 7 in each seal portion 6 does not exceed 5 mm.

The dimension of space 5 in the radial direction of arc tube 2 and outer tube 3 is 0.2 mm, and the vacuum or the pressure of the mercury vapor filling space 5 (hereinafter simply referred to as the pressure) undergoes changes of greater than 10,000-fold, from $10^{-3}$ Pa at −20° C., to $10^{-1}$, Pa at 20° C. and 10 Pa at 80° C. Though the radial dimension of space 5 is set at 0.2 mm, no problem will arise as long as said dimension is limited to no more than approximately 1 mm. Should the dimension of space 5 exceed 1 mm, however, the entire diameter of low-pressure mercury vapor-filled discharge lamp 1 becomes excessively large, and other problems also arise. For example, in cases where low-pressure mercury vapor-filled discharge lamp 1 is mounted on a luminaire or the like, the distance between arc tube 2 and the object of light incidence exceeds 1 mm, which causes an increase in light loss.

A low-pressure mercury vapor-filled discharge lamp 1 having the above configuration may be formed as follows: first, arc tube 2 is filled with a discharge medium principally comprised of mercury (Hg), and then sealed by attaching a Dumet wire 7 to each end of the tube. Thereafter, an end of arc tube 2 is aligned with one of the two ends of outer tube 3, and one end of arc tube 2 and outer tube 3 are melted by using a gas burner, thereby sealing them together where Dumet wire 7 is located. Then, impure gas in space 5 is discharged by heating the area to a high temperature, e.g. more than 400° C., while discharging the gas by means of a vacuum system. When the inside of space 5 becomes a high vacuum of $10^{-5}$ Pa, mercury is enclosed in space 5. Finally, the formation of the low-pressure mercury vapor-filled discharge lamp 1 is completed by heating the second end of arc tube 2 at the exhaust side over outer tube 3, thereby sealing arc tube 2 and outer tube 3 principally around the Dumet wire 7.

A lighting circuit arranged as shown in FIG. 1(*b*), adapted to produce a pulsed output voltage waveform of 40 kHz or more, voltage ranging from approximately 400 to 500 V, lamp current of approximately 5 mA or less and electric power input to the lamp of approximately 2 W is connected to the cold cathodes 8,8.

Next, the function of the embodiment described above is explained hereunder.

First, voltage is applied across the path between the cold cathodes 8,8 through the lighting circuit, thereby actuating and lighting the lamp. As a result, electric discharge between the cold cathodes 8,8 excites mercury vapor, thereby exciting ultraviolet radiation with a wavelength of 254 nm, which causes light to be emitted by the three band phosphor.

When the temperature is low, ie. at −20° C., the lamp manifests a high thermal insulation efficiency with the vapor pressure in space 5 reduced to $10^{-3}$ Pa. The thermal insulation efficiency decreases to a certain extent at room temperature of 20° C., where the vapor pressure in space 5 slightly increases to $10^{-1}$ Pa. The thermal insulation is further reduced at a high temperature of 80° C., where the vapor pressure in space 5 increases to 10 Pa. Thus, the embodiment is capable of preventing a decrease in efficiency due to insufficient thermal insulation in a low power range at a low temperature, while improving the luminance by preventing saturation of light output which may otherwise be caused by an increase in temperature resulting from excessive thermal insulation in a high power range. Strictly speaking, the thermal conductivity of the gas in space 5 slightly changes in proportion to temperature, but the change in vacuum is several ten times larger than the extent of the change in thermal conductivity. Therefore, the optimum vacuum is maintained in accordance with a range of electric power.

Figure 13:
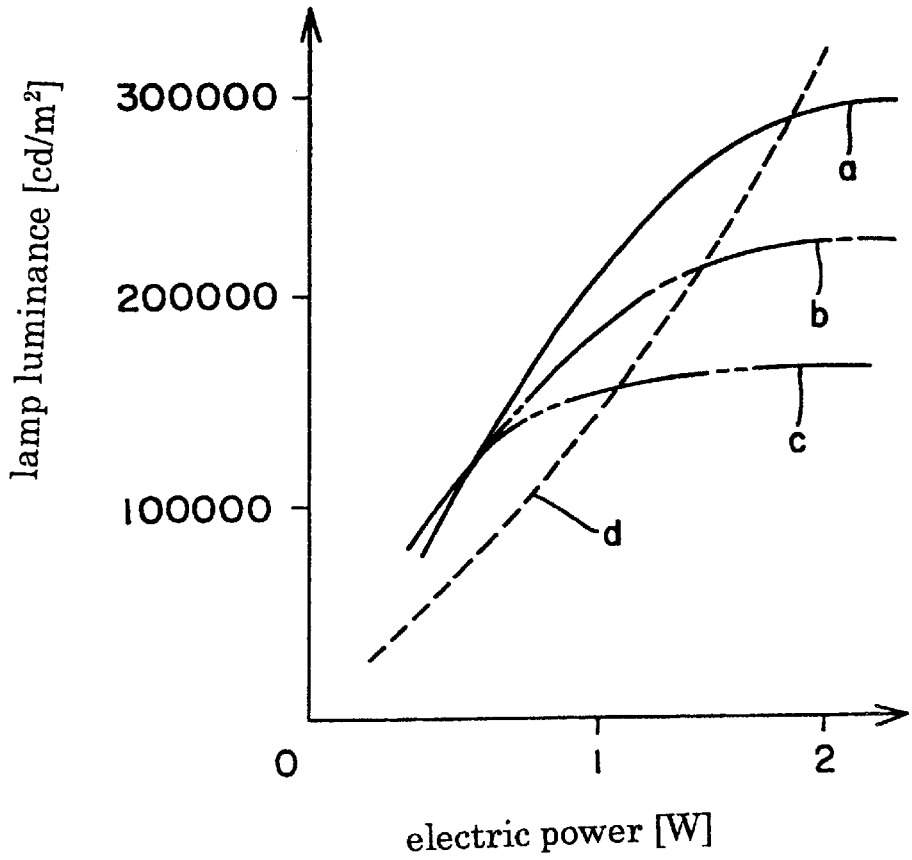
FIG. 13 is a graph showing the relationship between electric power and lamp luminance.

To be more specific, as shown in FIG. 13, a lamp a whose space 5 contains iodine and a lamp b whose space 5 contains mercury both present smaller luminance saturation, or more intense luminance, in the high power range compared with a lamp c whose space 5 is vacuum. Lamps a and b are both capable of maintaining an intense luminance in the low power range compared with a lamp d in which the pressure in space 5 is maintained at atmospheric pressure.

Figure 14:
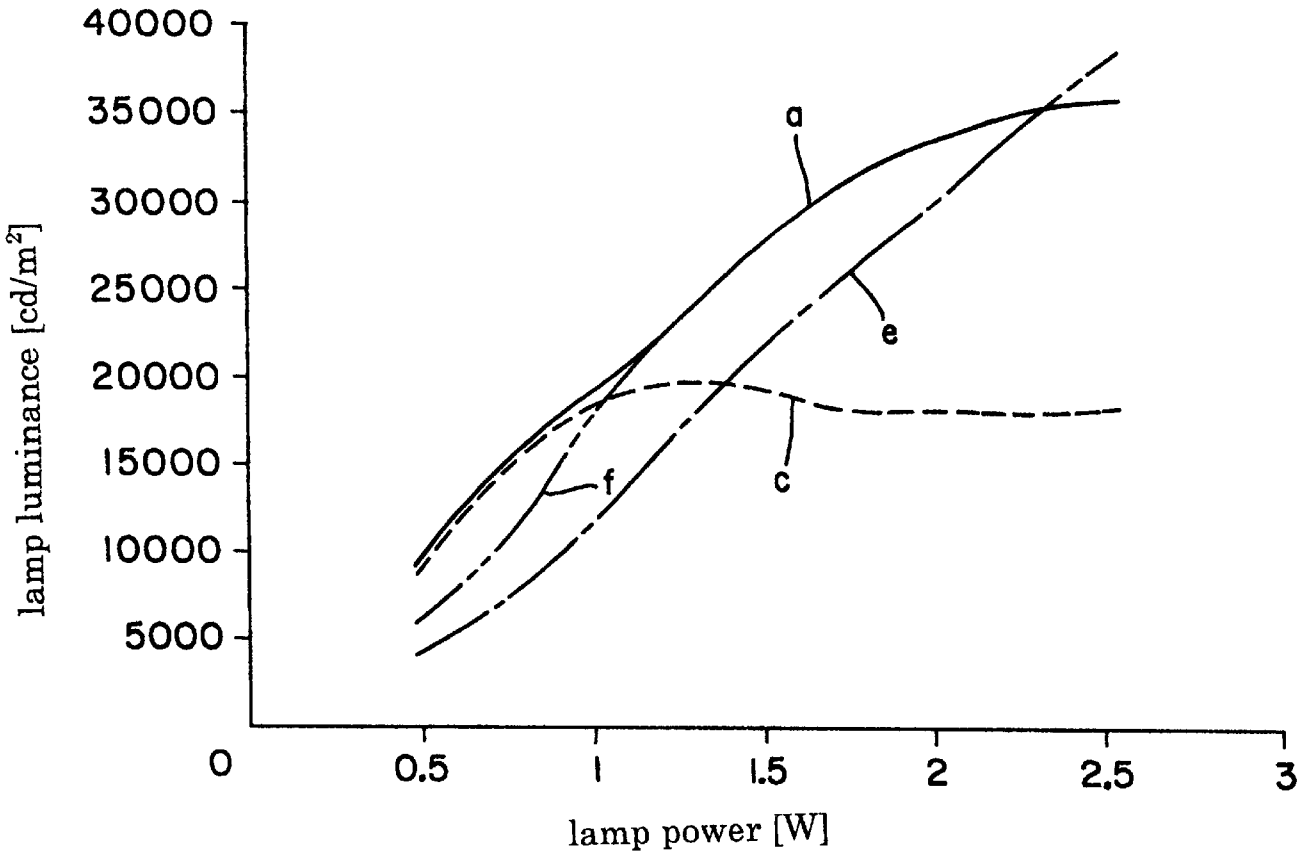
FIG. 14 is a graph showing the relationship between lamp power and lamp luminance.

The results of experiments using lamps having a full length of 200 mm are shown in FIG. 14. It is evident from these results that a lamp c whose space 5 is vacuum ($10^{-1}$ Pa) shows a higher lamp luminance than that of a lamp e of which the pressure in space 5 is maintained at atmospheric pressure and a lamp f whose space 5 contains nitrogen gas ($N_2$) at 10 Pa when the power input to the lamp is in a low range. But, as the lamp power increases, the lamp luminance of lamp c becomes lower than that of the lamp e, which has a single tube only. However, the luminance of a lamp a whose space 5 contains iodine is identical to that of the c whose space 5 is vacuum while the lamp power is in a low range and becomes virtually identical to that of lamp f with the space pressure of 10 Pa when the lamp power increases. Therefore, in general cases, a lamp of type a, which contains iodine in the space thereof and has a superior lamp luminance compared with a single-tube type lamp, is probably appropriate. The reason for the superior luminance seems to be that iodine itself has a large mass and, therefore, does not easily conduct heat.

Figure 15:
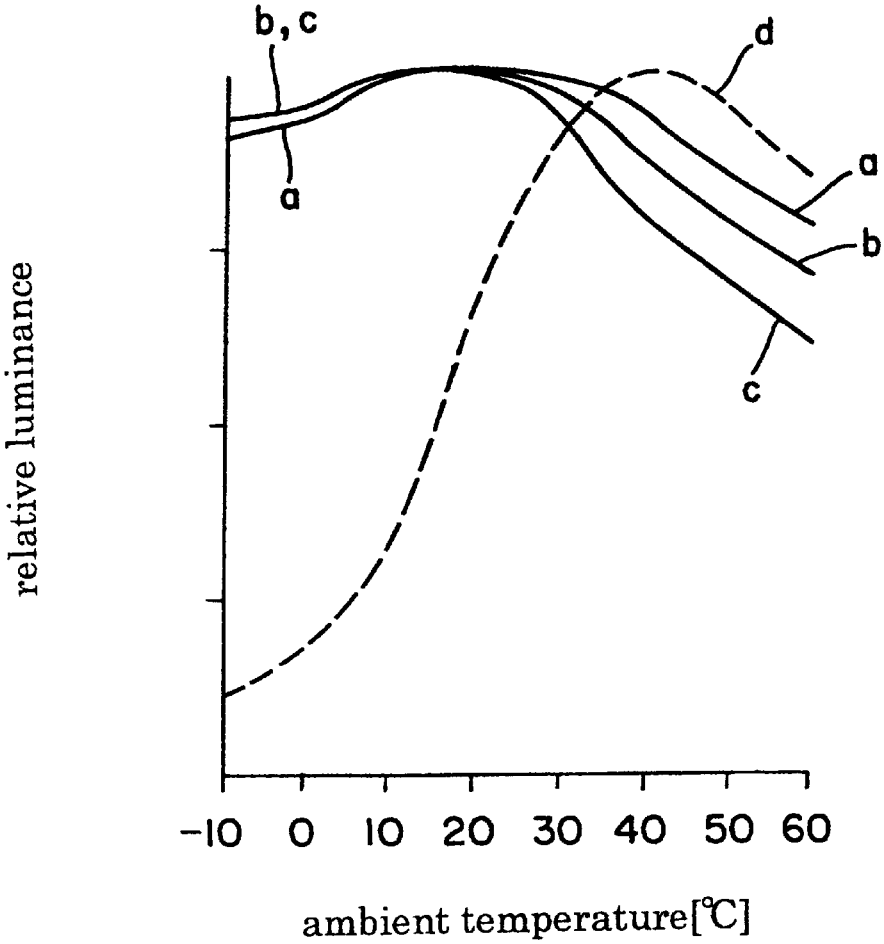
FIG. 15 is a graph showing the relationship between ambient temperature and relative luminance.

The relationship of luminance and the ambient temperature is shown in FIG. 15. Although relative luminance of a lamp a whose space 5 contains iodine is slightly less than that of a lamp c whose space 5 is vacuum in the lower temperature range, the lamp a with iodine and a lamp b whose space 5 contains mercury both present smaller luminance saturation, in other words more intense relative luminance, in the high power range compared with the lamp c whose space 5 is vacuum. Lamps a and b both have a more intense relative luminance in the low power range compared with a lamp d in which the pressure in space 5 is maintained at atmospheric pressure.

Thermal conductivity is proportional to the dimension of space 5 and is not directly related to the internal pressure. However, when the mean free path in the internal gas exceeds the dimension of space 5, free-molecule thermal conduction makes the thermal conductivity dependent on vapor pressure. In order to obtain optimal characteristics nearly the same as those of a non-double-tube type low-pressure mercury vapor-filled discharge lamp in response to the recent need for a thinner device, the dimension of space 5 should not exceed 1 mm. In that case, the mean free paths of the majority of atoms and molecules exceed the dimension of space 5 due to decrease in vapor pressure, and the thermal conductivity therefore changes in accordance with changes of vapor pressure. In other words, reducing the dimension of space 5 causes the thermal conductivity to change in accordance with a change in vapor pressure.

Yet another embodiment of the invention is explained hereunder.

Figure 16:
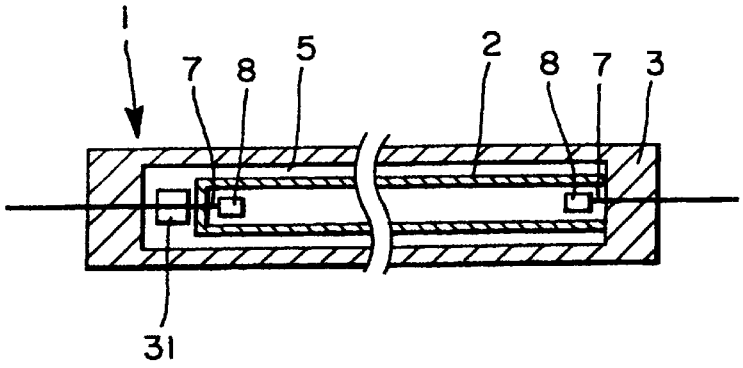
FIG. 16 is a transverse cross section of a low-pressure mercury vapor-filled discharge lamp according to another embodiment of the present invention.

Referring to FIG. 16, an arc tube 2 has a total length of 250 mm, an outer diameter of 2.6 mm and a thickness of 0.3 mm. A three band phosphor is applied to the inner surface of the tube. The interior of the tube is filled with neon (Ne) gas at 80 Torr, xenon (Xe) gas and mercury vapor.

An outer tube 3 is so disposed as to encompass arc tube 2 with a space 5 therebetween. The pressure in space 5 is virtually high vacuum of not more than 1 Torr, desirably $10^{-2}$ Torr or less. For example, it may be $10^{-5}$ Torr. The outer tube 3 has a total length of 250 mm, an outer diameter of 4 mm and a thickness of 0.3 mm. A getter member 31 for gas absorption is contained in space 5 and supported on Dumet wire 7.

A lighting circuit arranged as shown in FIG. 1(*b*), adapted to produce a pulsed output voltage waveform of 60 kHz or more (desirably 100 kHz), voltage ranging from approximately 400 to 500 V and lamp current of approximately 5 mA or less is connected to the cold cathodes 8,8.

Next, the function of the embodiment described above is explained hereunder. First, voltage is applied across the path between the cold cathodes 8,8 through the lighting circuit, thereby actuating and lighting the lamp. As a result, electric discharge between the cold cathodes 8,8 excites mercury vapor, thereby exciting ultraviolet radiation with a wavelength of 254 nm causing light to be emitted by the three band phosphor.

A reflecting mirror 15 as in the embodiment shown in FIGS. 1 and 2 is attached to outer tube 3, which has an outer diameter of 4.0 mm and an inner diameter of 3.4 mm and encompasses arc tube 2 having an outer diameter of 2.6 mm so that the distance between arc tube 2 and the reflecting mirror 15 exceeds the dimension of space 5, i.e. 0.8 mm. The space 5 is a high vacuum of $10^{-5}$ Torr, the airborne particle volume decreases, and micro electric current from arc tube 2 to the reflecting mirror 15 that functions as a proximity conductor is also reduced, resulting in reduction in current leakage. This is especially advantageous for a low-power appliance such as a CAD or other portable devices, because the reduction of current leakage results in improved efficiency, and this enables the equipment to be used for a longer time or to be able to powered by a more compact power source. In addition, as the heat retaining effect is achieved by space 5, arc tube 2 can be maintained at a constant temperature even if the discharge lamp 1 is of a type with a low-power consumption and a small heat capacity.

The embodiment described above includes a gas absorbing getter member 31. Therefore, even if gas absorbed by arc tube 2 and/or the Dumet wires 7 is desorbed when outer tube 3 is heated to be sealed or in other occasions, the gas absorbing getter member 31 absorbs the gas and thereby prevents reduction of the vacuum in space 5. According to the embodiment, a gas absorbing getter member 31 is provided only at one end of the discharge lamp 1. However, the same effect can be achieved if a getter member 31 is provided at each end.

Furthermore, as a film which is coated with a conductive member such as a layer of metal by means of vapor deposition can be used as a reflecting mirror 15, the embodiment is capable of improving usage efficiency of light emitted from a low pressure mercury vapor-filled discharge lamp 1. Materials of other types than a conductive member, such as various synthetic films or plastic members, increase the airborne particle volume. Nevertheless, they may be used, because the presence of space 5 reduces the airborne particle volume and consequently reduces leakage of current. Furthermore, by using a ceramic piezoelectric element instead of a wirewound transformer or the like and thereby increasing the frequency, the size of a lamp can be substantially reduced. It is thus possible to make a circuit more compact and efficient.

Yet another embodiment of the invention is explained hereunder.

Figure 17:
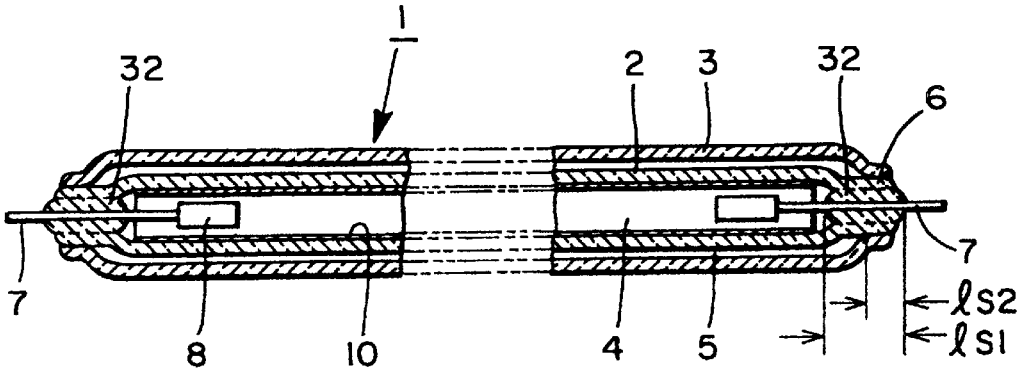
FIG. 17 is a transverse cross section of a low-pressure mercury vapor-filled discharge lamp according to yet another embodiment of the present invention.

Referring to FIG. 17, an arc tube 2 and an outer tube 3 are sealed together by means of elongated bead stems 32. The axial length each bead stem 32, along which the tubes are sealed, is longer than the diameter of the stem. Designating the lengths of each sealed portion of arc tube 2 and each sealed portion of outer tube 3 respectively as $1_{s1}$ and $1_{s2}$, the sealed portion length $1_{s1}$ of arc tube 2 may be a desired length while the sealed portion length $1_{s2}$ of outer tube 3 has to satisfy $1_{s1} \leqq 1_{s2}$. Providing this range of $1_{s1} \leqq 1_{s2}$, reduces generation of tensile stress on arc tube 2, when outer tube 3 is heated and welded to arc tube 2. Therefore, even if arc tube 2 has tiny flaws called Griffith's flaws, cracks will not be easily formed on arc tube 2 by tensile stress. In addition, even if stress on the interface of arc tube 2 and outer tube 3 causes peeling, there is less danger of cracks being formed by insufficient heating. Furthermore, should welding occur under an atmospheric pressure where the pressure in arc tube 2 is lower than the atmospheric pressure, cracks would seldom form.

An outer tube having an outer diameter of 8 mm or less may be used for any one of the embodiments described above. Taking into consideration the recent trend toward compact appliances on which a device according to the invention may be mounted, however, it is desirable that the outer diameter of the outer tube is not more than 4 mm, with the optimal diameter being not more than 3 mm. The thickness of the tube wall has to be not more than 1 mm and may desirably be in the range of 0.1 to 0.7 mm and optimally about 0.3 mm. Although the outer tube may have a desired full length, it is recommended that the lamp length ranges from 30 to 300 mm, and optimally from 50 to 200 mm.

The term "principal gas" or "principal filler gas" referred to in this specification means of all the gases in a space, the one that exists at a partial pressure ratio of generally more than 50%.

The arc tube 2 and outer tube 3 may be made of an arbitrary material, such as soda lime glass lead glass or hard glass. Although it is preferable that arc tube 2 and outer tube 3 are made of the same material, no problem will be caused even if they are produced of different materials. It is also desirable that arc tube 2 and outer tube 3 are made of semi-hard glass having a thermal expansion coefficient $\alpha$ of 50 or less. However, they may be produced of different materials; for example, one of the tubes may be made of soft glass while the other may be of hard glass. Furthermore, the cross section of each tube is not limited to a circle but may be of a desired shape, including an ellipse. The lengthwise shape, too, is not limited to a straight tube but may be of a desired shape, including a circle, a semi-circle, and a shape resembling the letter L, U or W.

The measurement of the outer diameter of arc tube 2 may include a heat insulating means.

Unless otherwise specified, the term, "room temperature atmosphere" or "atmosphere at room temperature" relates to a state where the ambient temperature is approximately 25° C. However, in cases where a lamp is incorporated in another device such as a subsurface illuminator, the term may mean the actual temperature of the ambience encompassing the device. With regard to the thickness of a tube wall, it does not matter whether the walls of the inner tube and the outer tube have an identical thickness or either one is thicker than the other.

The space between arc tube 2 and outer tube 3 is hermetically sealed by welding an end of one tube to the corresponding end of the other tube ends there is no intermediate member, this method not only facilitates the production process but also reduces distortion which may otherwise be caused by heating when the tubes are sealed together. Thus, the invention provides a lamp which is not easily damaged, has superior vacuum-tightness, and presents no danger of leakage even in high vacuum.

Each cold cathode 8 may include a mercury (Hg) alloy in its nickel or stainless (SUS) sleeve, and the outer surface of the cathode 8 may be coated with $BaAl_2O_4$ by means of thermal spraying. Examples of materials which can be used in place of $BaAl_2O_4$, include $LiAlO_2$, as well as various complex oxides, each of which is produced by adding a metal selected from a group consisting of tantalum (Ta), tungsten (W), titanium (Ti) and zirconium (Zr) to either lithium (Li) or barium (Ba).

Each cold cathode 8 may also contain an electron emissive substance, which may be substituted for by a substance which is capable of actively emitting secondary electrons through gamma-ray actions such as cation bombardment. Examples of said substituting substances include: $LaSrCoO_3$, $LaB_6+BaAl_2O_4$, $LaSrCoO_3+BaAl_2O_4$, $LaSrCrCoO_3+BaAl_2O_4$, $LaSrCoO_3+LaB_6+BaAl_2O_4$, $LaSrCrCoO_3+LaB_6+BaAl_2O_4$, $LaB_6+BaTiO_3$, $LaSrCoO_3+BaTiO_3$, $LaSrCrCoO_3+BaTiO_3$, $LaSrCoO_3+LaB_6+BaTiO_3$, and $LaSrCrCoO_3+LaB_6+BaTiO_3$. By causing the cold cathodes 8,8 to actively emit secondary electrons through gamma-ray actions, the above configuration prevents a decrease in efficiency in a low temperature environment. Further, hot cathodes may be used instead of cold cathodes 8,8.

Phosphor 10 is not limited to a three band type; any desired type, including a monochromatic type, is applicable.

A discharge medium usually contains mercury and a noble gas, e.g. neon gas or argon gas, as the principal components. In the present embodiment, however, a noble gas (xenon gas to be more precise) alone is used without using mercury so that electric discharge in the xenon gas causes emission of ultraviolet lit which excites the phosphor 10. On the other hand, xenon gas and mercury may be used together so that electric discharge in the xenon gas and discharge in the mercury vapor generate ultraviolet radiation with respective wavelengths. The noble gas for filling the tube together with mercury may be one selected from among argon, neon and krypton, or a combination of argon and neon, or a combination of argon, neon and helium. By using such a noble gas or noble gases together with mercury is, the starting characteristics are improved because of the Penning effect. Furthermore, mercury as a filler may be used in the form of either pure mercury or an amalgam.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A low-pressure mercury vapor-filled discharge lamp comprising:

a translucent body;

first and second spaced apart electrodes sealed in said body;

said first and second electrodes being cold cathodes;

means in said body for permitting a gas discharge to be produced between said first and second electrodes;

a thermal insulation means surrounding at least a portion of said body;

said thermal insulation means having an outer diameter of not more than 8 mm;

said thermal insulation means including cooperating means cooperating with said body to attain an illumination of said discharge lamp at a substantial fraction of a stable luminance within a predetermined time, over a substantial ambient temperature range.

2. A low-pressure mercury vapor-filled discharge lamp as claimed in claim 1, wherein:

said cooperating means including a translucent body spaced a distance outward from said body, and defining a space therebetween;

at least one gas in said space; and at least one of a dimension of said space, a composition of said at least one gas, and a pressure of said at least one gas being effective to produce said luminance at 50 percent of said stable luminance within 60 seconds when said ambient temperature is about 0 degrees C.

3. A low-pressure mercury vapor-filled discharge lamp as claimed in claim 1, wherein:

said body is a sealed tubular body;

said means in said body for permitting a gas discharge includes a gas in said tubular body and said first and second electrodes disposed at opposed ends of said body; and said thermal insulation means having a dimension and a content effective for reducing by 10% an input voltage applied to said lamp required to obtain a load applied to a wall of said tubular body of about 0.1 $W/cm^2$ at an ambient room temperature.

4. A low-pressure mercury vapor-filled discharge lamp comprising:

an inner tube;

said inner tube including means for producing a gas discharge therein;

an outer tube sealed at its ends to said inner tube;

a space between said inner tube and said outer tube;

at least one gas in said space;

at least one of a dimension of said space and a partial pressure of said gas in said space being effective to vary a thermal conductivity in said space over values suitable for maintaining a brightness of said discharge lamp over a substantial ambient temperature range.

5. A low-pressure mercury vapor-filled discharge lamp as claimed in claim 4, wherein parameters controlling said thermal conductivity are effective to increase said thermal conductivity as ambient temperature increases whereby said thermal conductivity is low at low temperatures, thereby improving a time required to attain full brightness, and where said thermal conductivity is higher at high temperatures, thereby improving operation of said lamp at high temperatures.

6. A low-pressure mercury vapor-filled discharge lamp as claimed in claim 4 wherein said space is less than 0.1 mm.

7. A low-pressure mercury vapor-filled discharge lamp as claimed in claim 4, wherein both the inner and outer tubes have a thickness that is less than 0.1 mm.

8. A low-pressure mercury vapor-filled discharge lamp as claimed in claim 4, where said space is maintained at a pressure of no more than 1000 Pa.

9. A low-pressure mercury vapor-filled discharge lamp as claimed in claim 4 wherein said means for producing a gas discharge comprises at least two cathodes; and said cathodes are coated with a material including one of $BaAl_2O_4$ and $LiAlO_2$.

10. A low-pressure mercury vapor-filled discharge lamp as claimed in claim 4 where said means for producing a gas discharge includes at least a mixture of xenon and mercury.

11. A low pressure mercury vapor-filled discharge lamp as claimed in claim 4 further comprising:

a reflecting mirror disposed on one side of said discharge lamp;

a light conducting plate disposed on another side of said discharge lamp;

a liquid crystal display unit; and a reflecting plate disposed facing said liquid crystal display unit.

12. A low pressure mercury vapor-filled discharge lamp as claimed in claim 4, wherein:

said at least one gas is selected from the group consisting of Kr and Xe.

13. A low pressure mercury vapor-filled discharge lamp as claimed in claim 4, wherein:

the length of said lamp is approximately 120 mm;

said inner tube has an outer diameter not more than approximately 3 mm;

said outer tube has an outer diameter not more than approximately 4 mm; and said space has a radial diameter of approximately 0.2 mm and a pressure of not more than approximately 100 Pa.

14. A low pressure mercury vapor-filled discharge lamp as claimed in claim 4 further comprising a lighting circuit coupled to said cathodes effective to produce a pulsed output voltage waveform of at least 60 kHz, a voltage of approximately 400 to 500 V, and a lamp current of not more than approximately 5 mA.

15. A low pressure mercury vapor-filled discharge lamp as claimed in claim 4 further comprising:

a seal between said outer and inner tubes;

said seal sealing said outer tube over said inner tube with said space therebetween;

said seal including at least one elongated bead stem whose axial length is longer than its diameter; and a length of a sealed portion of said inner tube is not more than a length of a sealed portion of said outer tube.

16. A low pressure mercury vapor-filled discharge lamp as claimed in claim 14 where said circuit is effective apply a load to a wall of said inner tube of 0.04 $W/cm^2$ even when an electric input power across said cathodes is less than 3 W.

17. A low-pressure mercury vapor-filled discharge lamp comprising:

an inner tube having an inner diameter of not more than 3 mm;

cold cathodes disposed at both ends of said inner tube and sealed therein;

an outer tube encompassing said inner tube defining a space therebetween;

a pressure in said space so reduced that the electric power input to the discharge lamp produces the maximum efficiency luminosity (1 m/W) when the lamp is lit at room temperature atmosphere and is at least 15% lower than in a case where a lamp having only an inner tube is lit.

18. A low-pressure mercury vapor-filled discharge lamp comprising:

an inner tube containing a discharge medium principally comprised of mercury hermetically sealed therein;

cold cathodes disposed at both ends of said inner tube and further sealed therein, an outer tube having an outer diameter of not more than 8 mm encompassing said inner tube defining a space therebetween of not more than 1 mm in radial diameter; and said outer tube is hermetically sealed to said inner tube with a pressure in said space not more than 1000 Pa.

19. A low-pressure mercury vapor-filled discharge lamp as claimed in claim 4 where said partial pressure is less than 0.3 times a molecular weight of said gas when a load applied to a wall of said inner tube is less than 0.1 $W/cm^2$.

20. A low-pressure mercury vapor-filled discharge lamp as claimed in claim 4 where said pressure in said space is at least 0.3 times a molecular weight of said gas and said pressure is less than 2 times a molecular weight of said gas when a load applied to a wall of said inner tube is at least 0.1 $W/cm^2$.

21. A low-pressure mercury vapor-filled discharge lamp as claimed in claim 18, wherein:

said inner and outer tubes are glass; and a seal between said inner and outer tubes integrally seals and welds them together.

22. A low-pressure mercury vapor-filled discharge lamp as claimed in claim 21, wherein the inner tube and the outer tube each include sealed portions, and a sealed portion of said inner tube has a length not more than a length of a sealed portion of said outer tube.

23. A low-pressure mercury vapor-filled discharge lamp as claimed in claim 18 wherein:

said outer tube has an outer diameter within twice an outer diameter of said inner tube; and said outer tube has a wall thickness within 10% of the outer diameter of the outer tube.

* * * * *